United States Patent [19]

Elder

[11] 4,323,210

[45] Apr. 6, 1982

[54] MANUAL BLOCK TRAFFIC CONTROL AND SIGNALING SYSTEM FOR RAILROADS

[75] Inventor: J. Calvin Elder, Penn Hills, Pa.

[73] Assignee: American Standard Inc., Swissvale, Pa.

[21] Appl. No.: 183,906

[22] Filed: Sep. 4, 1980

[51] Int. Cl.[3] ..... B61L 21/04

[52] U.S. Cl. ..... 246/26; 246/106

[58] Field of Search ..... 246/22, 24, 25, 26, 246/105, 106, 2 R, 14, 15

[56] References Cited

U.S. PATENT DOCUMENTS

| | | | |
|---|---|---|---|
| 554,884 | 2/1896 | Leonard | 246/26 |
| 863,913 | 8/1907 | Foster | 246/26 |
| 869,555 | 10/1907 | Daves | 246/26 |
| 882,143 | 3/1908 | Daves | 246/106 |
| 925,611 | 6/1909 | Taynton | 246/25 |
| 1,543,461 | 6/1925 | Underwood | 246/26 |
| 2,697,778 | 12/1954 | Hunsa | 246/26 |
| 2,700,727 | 1/1955 | Judge et al. | 246/26 |
| 2,739,230 | 3/1956 | Tizzano, Jr. et al. | 246/26 |

*Primary Examiner*—Gerald L. Brigance
*Attorney, Agent, or Firm*—A. G. Williamson, Jr.

[57] ABSTRACT

Adjacent stations along a single track railroad without continuous train detection, are coupled by a communication channel over which distinctive signals requesting, acknowledging, accepting, and confirming completion of, train movements are transmitted. The operator at the departure station manually initiates the transmission of a first signal requesting a train movement to the adjacent station. The other station operator acknowledges the movement request by manually actuating the transmission of a second distinct signal accepting the move. The two signals jointly establish the requested traffic direction through the single track and clear the departure signal for the train. Occupancy of the single track by the train locks the channel to inhibit other movement requests, thus protecting the train while moving through the non-detection stretch. Arrival of the train at the far station is registered and confirmed by the operator who manually actuates the transmission of a train complete third signal. This actuates the reset of that station apparatus and reception of this third signal at the departure station actuates a system reset to restore at-rest conditions to enable preparation for the next train. In a first specific arrangement, the communication channel comprises two normally energized DC line circuits, one in each direction. Signals are transmitted by reversing the line polarity and the system locked by deenergizing both line circuits. The channel in a second form is a normally deenergized reversible DC line circuit. Signals are transmitted by applying energy of predetermined polarity from one or the other staton. The line circuit is held deenergized to lock the system during train movement.

6 Claims, 11 Drawing Figures

MANUAL BLOCK TRAFFIC CONTROL AND SIGNALING SYSTEM FOR RAILROADS

BACKGROUND OF THE INVENTION

My invention pertains to manual block traffic control and signaling systems for railroads. More particularly, the invention relates to a traffic control and signaling system, for a single track railroad, which is manually controlled by operators at adjacent stations and which does not provide continuous track circuit train detection between such stations.

There are many stretches of railroad throughout the world on which the volume of traffic does not warrant an extensive and sophisticated centralized traffic control and signaling system. In many situations or locations, the local economy and resources and the economics of the existing traffic level do not even warrant nor permit the installation of a less sophisticated signaling system such as automatic permissive block with full train detection and automatic opposing traffic protection. Yet in all places safety concerns make some form of simple traffic supervision with train movement control signals desirable, in order to protect lives and property where train operation, particularly in opposing directions on a single track, is otherwise without signals. On such low traffic railroads, a control system which requires the least initial apparatus and installation expense can find use and is desirable. Such systems may use manual control and participation by station operators who are already employed and have other duties. These operators will be located at siding locations where trains may meet or pass and may thus govern the movement of the trains to and from adjacent stations along the single track railroad. A form of check-in and check-out train detection, to avoid the installation of continuous track circuits for train detection, may be made a part of the system. Such apparatus preferably is of a modular arrangement for easy maintainence and simple upgrading, as increased traffic warrants improvements. In other words, a manually controlled station-to-station block signaling arrangement of traffic control which provides protection against opposing train movements in single track and has low cost is a highly desirable improvement for light traffic railroads.

Accordingly, an object of my invention is a traffic control system for single track railroads.

Another object of the invention is a traffic control system for single track railroads without continuous train detection between stations and with station-to-station control blocks and an operator's console at each station for manual control of the intervening block.

Still another object of the invention is a manual block signaling system for railroads, with train detection only at interlocking station locations, which requires positive action by operators at adjacent stations to authorize train movement from the requesting station to the far station at the other end of the single track block and which further requires the operator at the far station to manually confirm the completed arrival of the train before the traffic locking for that train can be released.

A further object of my invention is a traffic control and signaling system, for single track railroads without track circuits between stations, in which authorization for train movement from a first to a second station at the ends of a single track stretch is initiated by the operator at the departure station, acknowledged and completed by the operator at the other station, and which protects that train from opposing train movements during passage through the single track stretch.

Another object of my invention is a manual block traffic control and signal system for a single track railroad without continuous train detection in the single track stretches between adjacent stations, in which a request for a train movement is manually initiated by the operator at the departure or near station, transmitted as a first signal, having a predetermined characteristic, over a communication channel between the stations, and registered at the far end station; acknowledgement of the received request by the far station operator initiates the transmission of a distinct characteristic second signal over the channel to the near station where reception establishes the requested traffic direction and clears the departure signal for the train; acceptance of the signal and movement of the train into and through the single track locks the communication channel and thus the system to inhibit any action by the operators to change traffic direction or clear a signal for any opposing or following moves, the far operator confirms the detected arrival of the train to initiate the reset of the far station apparatus and the transmission of a third signal over the channel to the near station where its reception actuates the reset of the entire system including the communication channel to enable the preparation for the subsequent movement of a train in either direction.

Yet a further object of my invention is a manual block traffic control system for a stretch of single track railroad without track circuits and with operators at each of adjacent stations, in which a manually initiated request for train movement is transmitted over a first polarized line circuit from the leaving station to the arrival station, a manually initiated acknowledgement is transmitted back over a second polarized line circuit from the far to the near station to establish traffic direction and authorize train movement, the line circuits are locked out during such train movement, and the arrival of the complete train at the far station is manually confirmed to initiate restoration of the line circuits to clear out the traffic locking and release the single track block for further train movements.

A still further object of the invention is a manual block traffic control and signal system for a single track railroad without continuous train detection between two adjacent stations at either end of a single track stretch, in which a manually initiated first signal of selected polarity requesting a train movement from the originating one station to the other station is transmitted over a normally deenergized two-wire line circuit between the two stations and registered at the other station, a second signal of opposite polarity is manually initiated and transmitted from the other station to acknowledge and accept the train movement request, reception of the second signal at the one station establishing traffic direction and clearing the departure signal, movement of the train into the single track deenergizing the line circuit and locking the traffic direction to protect the train, and transmission of a manually initiated third signal confirming train arrival at the other station releases system traffic locking and deenergizes the line circuit to reset the system for subsequent train moves.

Other objects, features, and advantages of my invention will become apparent from the following description and appended claims when taken in connection with the accompanying drawings.

SUMMARY OF THE INVENTION

According to the invention, the manual block system controls train movements over a single track railroad by relying on the manual actions of operators at adjacent stations along the railroad. The operator at a first station initiates a request for a train movement from that station to a second station while the second station operator acknowledges and accepts the request, which actions jointly establish the authority for the train movement and lock the system to protect the moving train from conflicting moves. The second station operator confirms the completion of the movement when the train arrives and manually actuates a system reset to its unlocked, at-rest condition to enable preparation for a subsequent train movement. Each pair of stations at opposite ends of a stretch of single track railroad are coupled by a communication channel over which selectively characterized signals are transmitted. Each station has parallel passing tracks which merge into the single track at each end of the station through a simple interlocking which comprises a switch to route trains to and from the single track, a departure signal, and an entrance signal. Track circuit train detection is provided in each passing track, each switch detector section, and adjoining short approach sections. There are no other track circuits or other specific train detectors in the single track stretch between stations.

The system is normally at-rest with no established traffic direction nor any signals cleared. To establish traffic direction and clear a departure signal to authorize a train to move through the single track, the operator at the departure (near) station manually initiates the transmission of a first or request signal having a predetermined distinctive characteristic. This action stores a clear signal request for the train and transmits the first signal only if local interlocking conditions are proper and the system at the near station is determined to be at-rest. This signal is received at the station at the other end, i.e., the far station, and registered to inform that operator of the request. If the request is accepted, the far operator manually acknowledges to actuate the transmission of a second signal which has a characteristic distinct from that of the first signal. Reception of this second signal at the near station establishes the desired traffic direction and clears the departure signal for the train.

When this train accepts the clear signal and moves through the switch section into the single track, the line circuit is interrupted and held in a deenergized condition to lock the traffic direction and to protect the train while it moves through the single track where there is no detection. No other channel signal can be transmitted regardless of the manipulations of the controls by either operator. No other train movements, conflicting or otherwise, can be set up during this period of train travel.

Arrival of this train at the far station is registered by a directionally oriented detector means and an indication of the arrival provided for the operator. Having confirmed the arrival of the complete train, this far station operator manually actuates the transmission over the channel to the departure station of a third or train movement complete signal which has a distinct characteristic which because of the time interval, may be the same as the first or second signal characteristic. At the near station, the reception of the third signal actuates a reset of the apparatus to its at-rest condition. The transmission of the third signal at the far station also actuates a reset of the station apparatus. During the reset action, the communication channel is restored to its at-rest condition so that the system is prepared to establish a movement for the next train in either direction.

In a first specific form illustrated, the channel comprises a line circuit in each direction between the stations, i.e., a four-wire line circuit. Each line circuit is normally energized, one from each station, at the same selected polarity. To transmit the first signal, in response to the storing of a departure signal request by one operator, the polarity of the line circuit from that station is reversed. The acknowledgement signal from the other station also is transmitted by pole-changing the other line circuit energy. When the train moves into the single track, both line circuits are deenergized, which inhibits any traffic reversal or signal clearing by either station operator. Transmitting the train complete signal from the far station is accomplished by restoring normal polarity energy to the line circuit from that end. The reset action at the first station restores normal polarity energy to its originating line circuit and thus the system is reset.

In the second specific form disclosed, a single, two-wire, normally deenergized line circuit couples the two stations. Energy of a first selected polarity is applied at the near station to transmit the first or movement request signal. This signal is terminated by removing the energy and then the opposite polarity energy is applied from the other station to transmit the second or acknowledgement signal. When the train leaves the near station on a clear signal, the line circuit is deenergized and held in that condition by station apparatus to protect the train. The third or train complete signal is transmitted by applying reverse polarity energy from the far station. As the system resets, energy is removed and the line circuit is restored to its deenergized condition.

BRIEF DESCRIPTION OF THE DRAWINGS

Before defining my invention in the appended claims, I shall describe two specific arrangements of the system and apparatus embodying the invention, as shown in the accompanying drawings, in which:

Figure 1A:
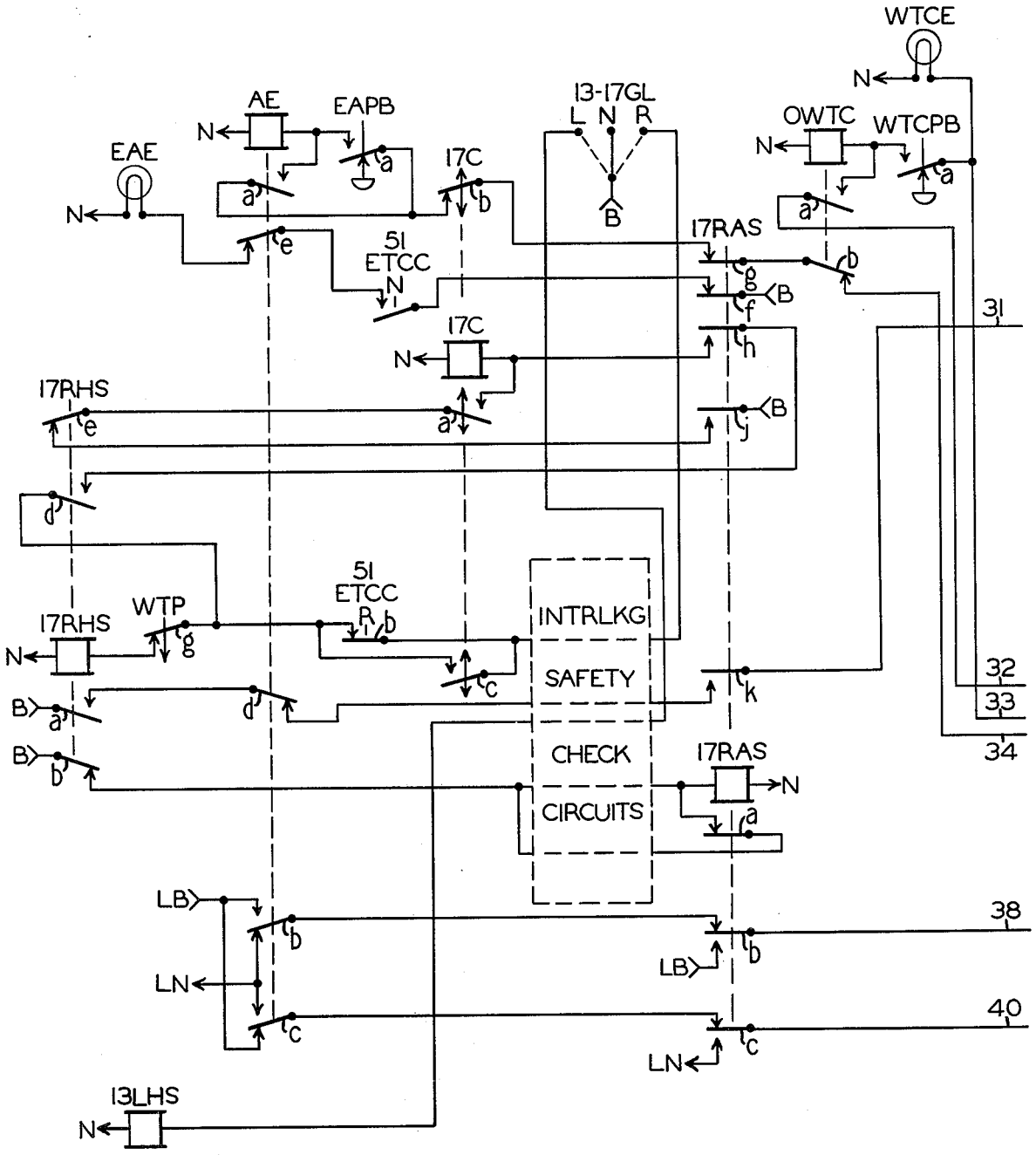
FIGS. 1A, B, C, and D, taken together, show, principally by schematic circuit diagram, the apparatus arrangement at and between two adjacent stations along a stretch of single track railroad provided with a first form of a manual block traffic control system embodying my invention.

In each of the drawing figures, the same or similar apparatus is designated by the same or similar reference characters. Also, conventional symbols are used for each type of apparatus illustrated. For example, relay windings are illustrated by conventional small blocks, each with a specific reference broadly representative of the relay use. When possible, contacts controlled or operated by a particular relay are shown in vertical alignment above or below the corresponding winding symbol. In either position, when the relay is energized all movable armatures move up to close against the associated front contacts. Conversely, with the relay winding deenergized, the armatures release and move down against the associated back contact. Each such relay contact is further designated by a lower case letter which is unique only within the contacts associated with that relay winding. However, to simplify the drawings, some contacts are shown separate from the windings, that is, not in alignment therewith. Such separated contacts are designated both by repeating the relay reference character and by the unique lower case letter reference for the specific contact. Slow acting relays are designated by vertical arrows drawn through the contact armatures with the arrow showing the direction of delayed movement. For example, relay 17C in FIG. 1A is both a slow release and a slow pickup relay, as indicated by the downward and upward pointing arrows drawn through the relay contacts. In other words, after the relay winding is deenergized, front contacts are held closed for a predetermined time period before the armatures release to close back contacts. Conversely, when the relay winding is energized, front contacts do not close for another predetermined time interval established by relay characteristics. Each station is provided with a source of low voltage direct current energy, of any well known type, for the operation of the relays and the signal and indication lamps. The specific sources are not shown since such use is conventional but connections to the positive and negative terminals thereof are designated by references B and N, respectively. A similar but higher voltage direct current source is provided for energization of the communication channel, i.e., line circuits, between stations and connections to this line circuit source are designated by the references LB and LN for the positive and negative terminals, respectively.

SPECIFIC DESCRIPTION OF THE ILLUSTRATED APPARATUS ARRANGEMENTS

Figure 1B:
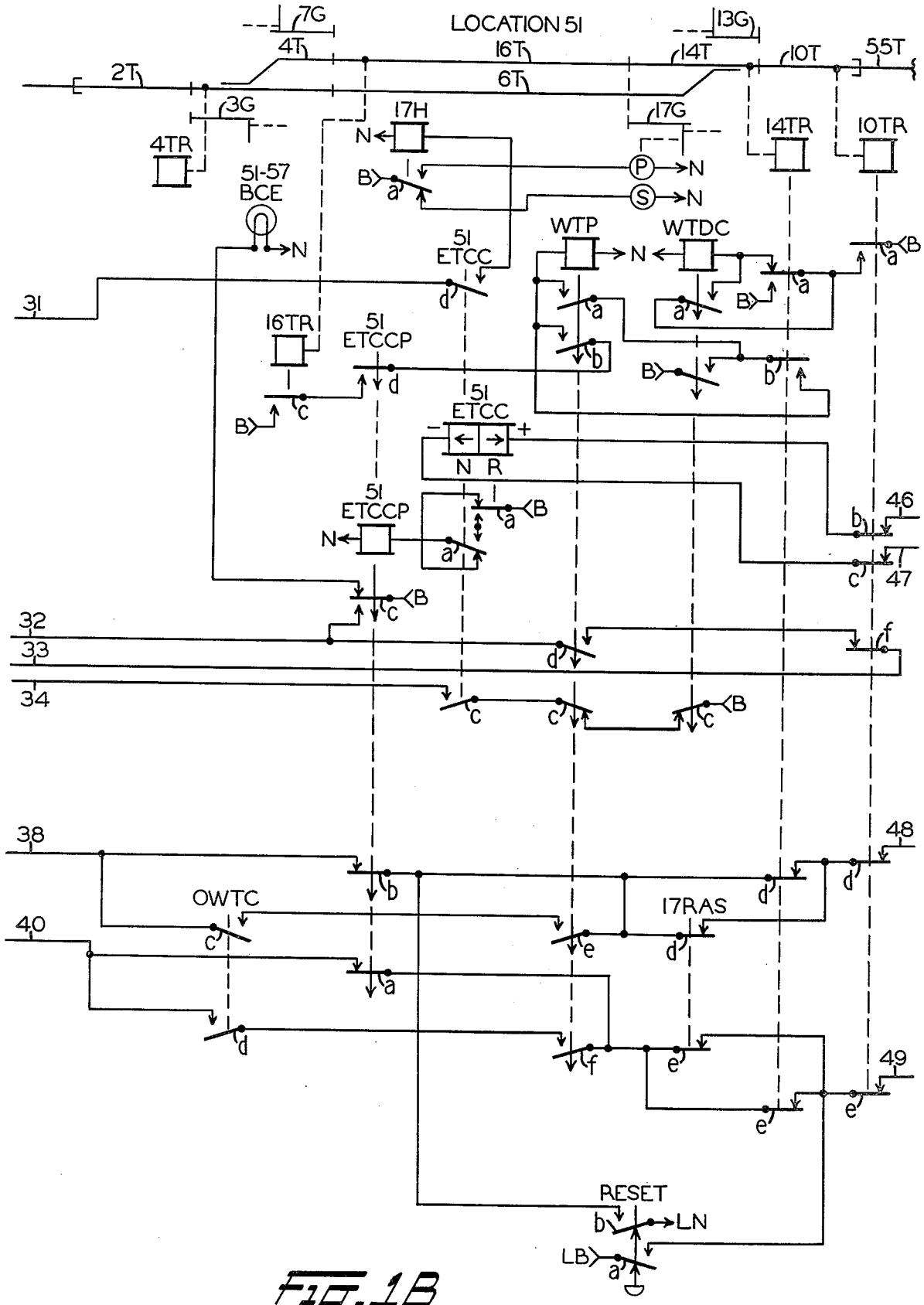
Figure 1C:
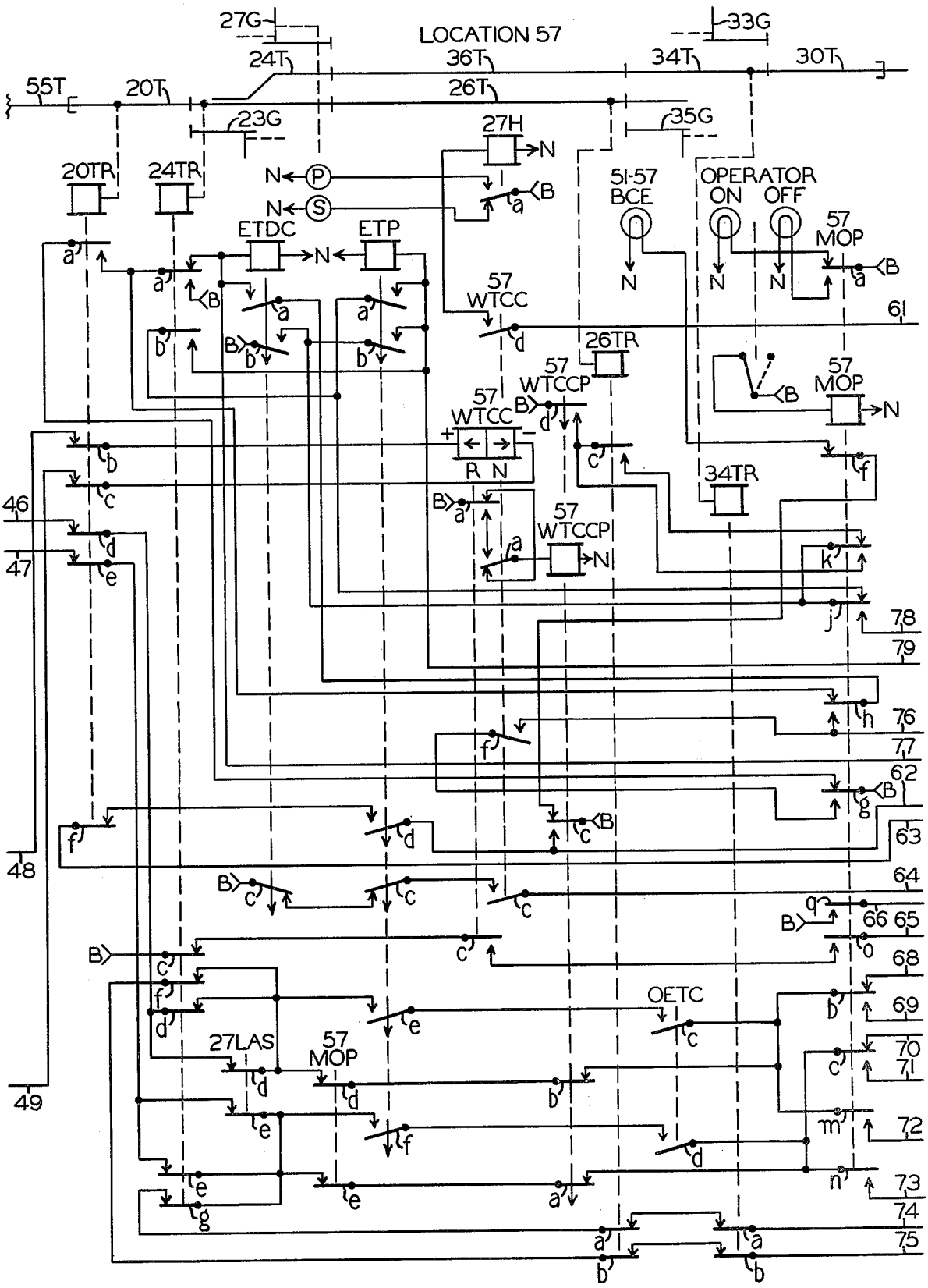
Figure 10:
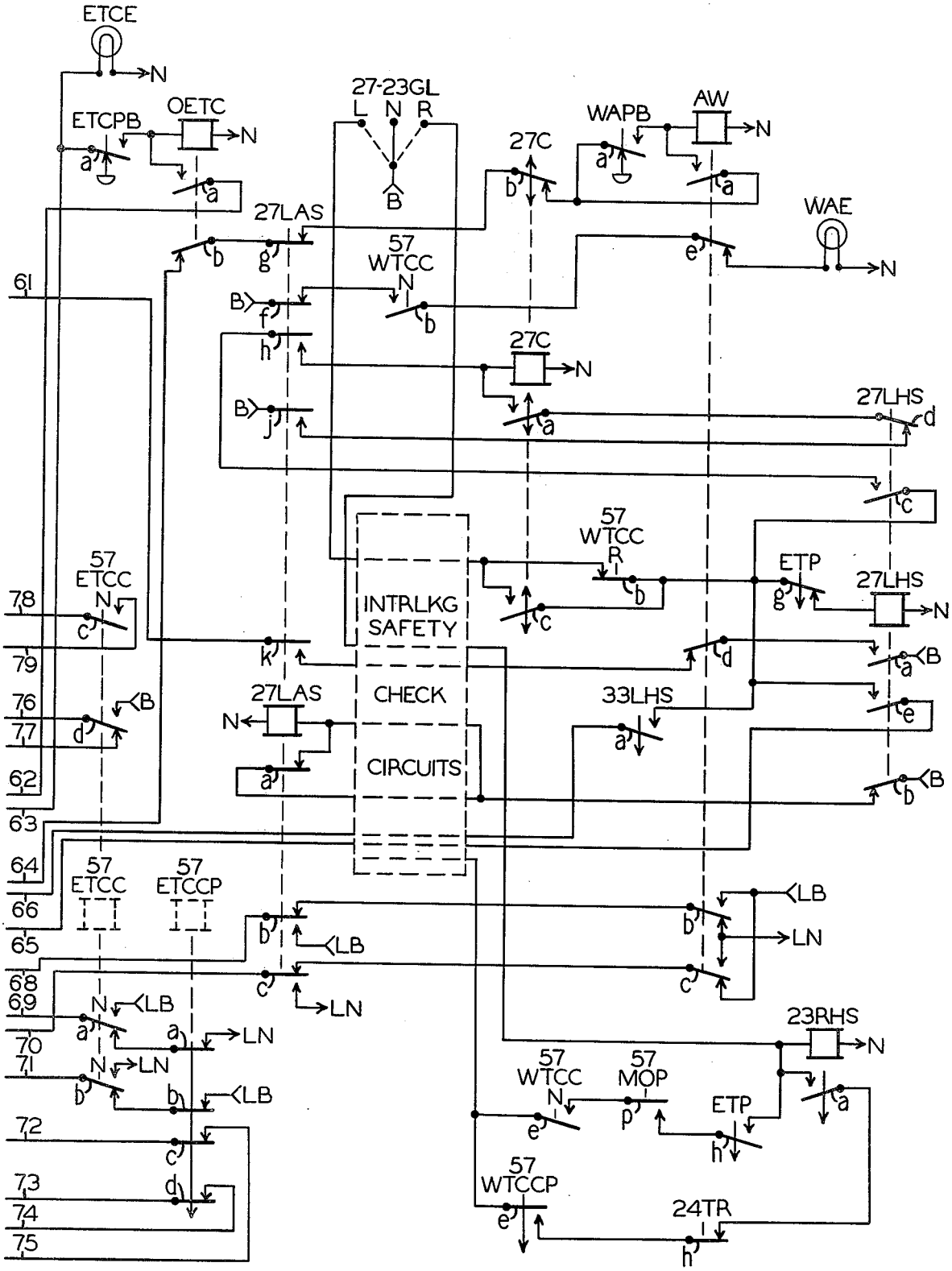

I shall refer first to the form of manual block traffic control system shown in the various parts of FIG. 1, in which a four-wire communication channel or line circuit is provided between adjacent station locations. By positioning FIGS. 1A, B, C, and D in order from left to right, with the correspondingly numbered intersheet connecting lines matched, an illustration of the circuits and apparatus for the signal and/or traffic control system between station locations 51 (FIGS. 1A, B) and 57 (FIGS. 1C, D) is provided. The communication channel between these two stations comprises the four line wires represented by leads 46, 47, 48, and 49 connecting between FIGS. 1B and 1C. As the description progresses, it will be become apparent that circuits at location 57 differ from those at location 51. This is due to the provision of additional circuits at location 57 to provide automatic operation during periods when a local operator is not on duty.

At the top of FIG. 1B, there is shown by conventional single line representation the passing track layout at station or location 51 which is positioned at the western end of a single track stretch designated by the reference 55T. This station includes two parallel tracks which merge into a single track at both the left and the right ends over conventional switches. These switches may be of a spring switch type which are positioned to move the train entering the station into the right-hand track and to permit the departing trains to trail out through the switch into the single track without stopping. Of course, these switches may also be of the well known hand-throw type or may be remotely controlled power switch movements if so desired. The tracks within location 51 are divided into insulated track sections by conventionally shown insulated joints. For example, the station tracks include sections 6T and 16T, the switch detector sections 4T and 14T, and approach detector sections 2T and 10T in the single track. Each insulated section is provided with a train detection track circuit of any known type. These train detection circuits are illustrated only by a conventionally shown associated track relay connected by a dotted line to the track representation. For example, for the approach section 10T at the right, a track circuit is represented by the illustrated track relay 10TR. It may be noted that no relay is shown associated with the approach section 2T since it is not involved in this specific description which follows. These are normally energized track circuits so that the associated track relay is normally picked up and releases when a train occupies the section to shunt the rails. The single track beyond section 10T, that is, stretch 55T, is not track-circuited so that there is no continuous train detection between this location and the equivalent station location 57 shown in FIG. 1C. Location 57 positioned at the east end of the single track stretch is of equivalent arrangement, as shown conventionally in FIG. 1C, with the parallel track sections and switches. In other words, there is an approach track section 20T, switch detector sections 24T and 34T, the parallel station track sections 26T and 36T, and an approach section from the east 30T. Each section is insulated and provided with a conventional track circuit for train detection, again illustrated by the associated track relays TR.

Train movements into and departing from the station locations are controlled by wayside signals shown by conventional symbols. For example, as eastbound train from station 51 is governed by departure signal 17G which, when operated to a clear or proceed indication, authorizes the train to move from section 6T (or 16T) through switch section 14T and approach section 10T into the single track stretch 55T. A similar departure signal 27G at location 57 controls westbound train movements from this station. The indication displayed by signal 17G is directly controlled by a signal relay 17H as shown symbolically in FIG. 1B. When relay 17H is in its released position (the normal condition), signal 17G displays a stop (S) indication while conversely, when relay 17H is picked up, signal 17G displays a proceed (P) indication. Relay 17H is controlled, i.e., its pickup is actuated, with safety circuit checks to be later described, by the right signal stick relay 17RHS shown at the left in FIG. 1A. This RHS relay is energized when an eastbound train movement from station 51 is requested, as will be later explained. At location 57, the westbound departure signal 27G is controlled by a signal relay 27H which, in turn, is controlled by the left signal stick relay 27LHS in a manner similar to that at location 51.

Briefly listing other relays at locations 51 which will be more fully described in the following discussion, they include an acknowledgement east relay AE with its associated indicator lamp EAE and the acknowledgement east pushbutton EAPB. It may be noted at this point that this pushbutton and other equivalent pushbuttons illustrated in the drawings are of the spring-return type in which the contacts are closed only when the pushbutton is actuated, that is, is pushed by the local operator. Also at location 51 is the operator westbound train complete relay OWTC with its associated indicator light WTCE and the westbound train complete pushbutton WTCPB. Also shown to complete the illustration is the left signal stick relay 13LHS and a correspondence relay 17C which is used to prevent simultaneous movement requests at each station from being registered. This latter relay, as previously discussed, has both slow pickup and release characteristics.

Also at location 51 but shown in FIG. 1B is a line relay or east train completeness check relay 51ETCC. This relay is of a biased, two-winding type as illustrated by the double symbol. A set of contacts controlled by each winding is illustrated above and below this relay symbol and also elsewhere in the circuit diagram. As indicated by the arrows shown within the winding symbols, a particular winding is properly energized to actuate or pick up its associated contacts only when conventional current flow through the relay windings is in the direction of that arrow. The left winding is designated as the normal winding by the reference character N and the right winding as the reverse winding by the reference character R. For example, only when current flows from right to left through the relay windings, i.e., in the positive to negative direction, is the left or normal winding responsive to pick up its contacts. The line circuit repeater relay 51ETCCP, which has slow release characteristics, is normally energized by a circuit between terminals B and N of the local source and including reverse (R) front contact a and normal (N) back contact a of relay 51ETCC. When relay 51ETCC is in its opposite energized position, the circuit for the repeater relay includes reverse back contact a and normal front contact a. It may be noted that, if the line relay is deenergized so that both sets of back contacts are closed, the repeater relay is also deenergized and will release at the end of its slow release timing period. Also shown in FIG. 1B are a westbound train detector relay WTDC and a westbound train repeater relay WTP which, as will be more fully described, are used to detect the arrival of only westbound trains.

A right approach stick relay 17RAS is shown in FIG. 1A, this being a conventional control and check relay for signaling systems. Relay 17RAS is normally energized over a stick circuit which includes back contact b of relay 17RHS and front contact a and the winding of relay 17RAS and various safety and checking circuits within the interlocking safety check circuits designated by the dot-dash block and the dashed lines within that block. The dashed lines within the interlocking safety check circuit block, and which are part of various circuits, designate conventional circuitry which is used to check the position of the switch within section 14T, the condition or position of opposing wayside signals, track occupancy conditions, and various timing periods. In other words, these are check circuits which would conventionally be used at an interlocking location even though of the simple nature of the single switch and two diverging tracks as indicated within section 14T. For purposes of the present description, it is only necessary to know that relay 17RAS is deenergized when relay 17RHS picks up and opens its back contact b. Relay 17RAS then is reenergized to pick up when relay 17RHS is subsequently released as the train moves through the interlocking and the interlocking check circuits complete the circuit for the approach stick relay which may under certain conditions include a timing period.

Equivalent relays are provided at location 57 plus a manual operator repeater relay 57MOP which is used to repeat or indicate the presence or absence of the local station operator. This relay is normally energized by a simple circuit over the operator lever in its left position, which is indicated, so that its contacts are picked up. When the operator is to be absent, the lever is placed in its righthand position so that the relay circuit is interrupted and the contacts are released. Indicator lamps as to the position of the lever are controlled by contact a of relay 57MOP, the operator ON light being energized when the relay contact is picked up and the OFF light when contact a is released to close its back contact. Because of relay 57MOP, there are slightly modified circuits for relays ETDC and ETP in FIG. 1C and in the line circuit network. To illustrate the system operation when the station operator is not present, other relays are shown by dotted symbols. No control circuits are shown for these phantom relays but they may be understood by reviewing equivalent circuits for similar relays fully illustrated at location 51. For example, relay 57ETCC in the lower left of FIG. 1D is the equivalent of relay 51ETCC at location 51 in FIG. 1B and the control circuits are similar as will be understood.

The apparatus in all the drawings is shown with the traffic control system in its at-rest condition with no trains moving through the single track stretch 55T or departing from either station. Thus all track relays TR are shown picked up although it may be noted that no track relay is shown for either section 2T or 30T since a train may be occupying these sections without any effect on the at-rest condition of the portion of the control system between the two illustrated locations. Operators are on duty at each station so that relay 57MOP in FIG. 1C is energized and its contacts picked up. No departure signal is cleared or requested so that the signal relays H and the signal stick relays HS are all in their released condition. A first or eastward line circuit between the two locations which includes the line wires 48 and 49 between FIGS. 1B and 1C is energized with a first polarity from the line circuit source at the west end or location 51. To provide an understanding of the line circuit network, this eastward line circuit may be traced from terminal LB at back contact c of relay AE over front contact c of relay 17RAS, lead 40, front contact a of relay 51ETCCP, front contacts e in multiple of relays 17RAS and 14TR, front contact e of relay 10TR, line wire 49, front contact c of relay 20TR in FIG. 1C, the windings of relay 57WTCC, front contact b of relay 20TR, line wire 48, front contact d of relay 10TR, front contacts d in multiple of relays 14TR and 17RAS, front contact b of relay 51ETCCP, lead 38, front contact b of relay 17RAS, and back contact b of relay AE to terminal LN of the line circuit source. Obviously, the conventional flow of current through the windings of relay 57WTCC in this line circuit at-rest is from right to left, that is, in the direction of the arrow of the reverse winding of this line relay so that the reverse (R) contacts of the relay are picked up to close in their front position, the normal (N) contacts being released. The repeater relay 57WTCCP is thus energized over front contact Ra and back contact Na of relay 57WTCC.

A second or westward line circuit which includes line wires 46 and 47 is energized at the eastern end of the stretch, that is, location 57. This line circuit is supplied with energy from terminals LB and LN at back contacts b and c of relay AW at the lower right of FIG. 1D and further includes front contacts b and c of relay 27LAS, leads 68 and 70, front contacts b and c of relay 57MOP, front contacts a and b of relay 57WTCCP, front contacts d and e of relay 57MOP, front contacts d and e of relay 24TR which are respectively in multiple with front contacts d and e of relay 27LAS, front contacts d and e of relay 20TR, line wires 46 and 47, front contacts b and c of relay 10TR, and the windings of line relay 51ETCC. It will be obvious from an inspection of the drawings that once again the conventional flow of current through the line relay windings is in the proper direction to properly energize only the reverse winding so that the R front contacts of relay 51ETCC are closed. Once again, the repeater relay 51ETCCP is energized by the circuit including front contact Ra and back contact Na of the line relay. At each location, the block clear indication lamp 51-57BCE is energized to display an indication of an unoccupied track stretch 55T. The location 51 energizing circuit includes front contact c of relay 51ETCCP while, at location 57, the corresponding circuit includes front contact f of relay 57MOP and front contact c of relay 57WTCCP.

It is now assumed that an eastbound train occupying section 6T is to move from station 51 to station 57. To initiate this action, the operator at station 51 moves the signal lever 13-17GL from the N to R position. This completes a circuit from terminal B through the interlocking safety check circuits and including front contact Rb of relay 51ETCC and back contact g of relay WTP to energize relay 17RHS. The dotted portion of this circuit within the interlocking circuit block will be understood to include safety checks that the opposing signal 13G is not cleared, that sections 14T and 10T are not occupied by a train, and that the switch in section 14T is in condition for a train movement. The pickup of relay 17RHS interrupts, at its back contact b, the stick circuit for relay 17RAS which releases. Release of relay 17RAS, at its contacts b and c, pole-changes the first or eastward line circuit so that the positive terminal LB is now connected to line wire 48 at the right of FIG. 1B. This transmits a first or movement request signal over the line circuit channel. At location 57, the energy applied to relay 57WTCC is reversed so that the R contacts of this relay release and the N contacts pick up. Repeater relay 57WTCCP remains picked up during this shift of contacts since it has slow release characteristics to bridge any brief interruption of its energizing circuit until reenergized over shifted contacts a of relay 57WTCC. It may be noted that, with front contact Rb of relay 57WTCC now open, signal stick relay 27LHS shown in FIG. 1D cannot now be energized to initiate the clearing of a westbound signal.

At station 57, the west acknowledging lamp WAE now lights to indicate the reception of the eastbound train movement request, the circuit including front contact f of relay 27LAS, front contact Nb of relay 57WTCC, and back contact e of relay AW. The operator at station 57 acknowledges the reception of this request, if he accepts the requested movement, by actuating pushbutton WAPB to close its contact a to energize relay AW. This circuit further includes back contact b of relay 27C, front contact g of relay 27LAS, back contact b of relay OETC, lead 64, front contact Nc of relay 57WTCC, and back contacts c of relays ETP and ETDC. These latter two back contacts and the back contact of relay OETC check that any preceding eastbound train is not entering or completing its movement into location 57 at this time. Relay AW picks up, closing its front contact a to complete a stick circuit bypassing the contact of pushbutton WAPB which opens when the operator releases the switch device. Indication lamp WAE is extinguished by the opening of back contact e of relay AW. The pickup of relay AW, at its contacts b and c, pole-changes the westward line circuit originating at this station so that positive terminal LB is now connected to line wire 46 at the left of FIG. 1C. The second or acknowledge signal is thus transmitted over the channel. As a result, the line relay 51ETCC at location 51 reverses its position, releasing R contacts and picking up N contacts. Signal relay 17H is now energized by the closing of front contact Nd of relay 51ETCC, the circuit originating at front contact a of relay 17RHS and further including back contact d of relay AE, safety check circuits within the interlocking block, back contact k of relay 17RAS, and lead 31. Obviously this circuit checks that a signal request was registered by relay 17RHS and that a westward movement request has not been received since relay AE is released. With relay 17H picking up to close its front contact a, signal 17G is actuated to display a proceed indication to authorize the eastbound train to depart from station 51.

When this train accepts the proceed signal indication and moves east into section 14T, relays 17RHS and 17H are immediately released by the interlocking check circuits. Relay 17RAS will eventually be energized and pick up but not until both sections 14T and 10T are occupied by this eastbound train. With front contacts d and e of relay 17RAS still open (FIG. 1B), the release of front contacts d and e of relay 14TR interrupts the eastward line circuit which is further interrupted at front contacts d and e of relay 10TR when this track relay releases as the train moves eastward. With this line circuit interrupted, relay 57WTCC is fully deenergized and releases all its contacts. This deenergizes its repeater relay 57WTCCP which releases at the end of its slow release period. The opening of front contacts a and b of relay 57WTCCP interrupts the second or westward line circuit originating at this station so that the corresponding line relay 51ETCC at station 51 is deenergized and releases all its contacts, followed by the release of the contacts of relay 51ETCCP. The opening of front contact Nc of relay 57WTCC interrupts the stick circuit for relay AW which then releases. However, front contact Nb of relay 57WTCC is also open so that the indicator light WAE is not reenergized. The release of contacts b and c of relay AW restores the application of normal polarity to the westward line circuit at its initial point but the line circuit remains interrupted as previously described.

This eastbound train then proceeds through the single track stretch 55T fully protected as it moves through this non-track-circuited stretch. This is assured by the open front contacts a and b of relay 51ETCCP at station 51 which maintain the eastward line circuit deenergized when front contacts of track relays 14TR and 10TR reclose as a train clears the corresponding sections. Further, front contacts a and b of relay 57WTCCP at station 57 retain the westward line circuit interrupted and thus deenergized. With relays 51ETCC and 57WTCC deenergized, no signal relay H can be energized to clear an opposing signal. In fact, no movement request can be transmitted from one station to the other with the two line circuits completely deenergized.

When the train arrives at station 57, it first occupies the approach section 20T. The release of track relay 20TR with relay 24TR still picked up completes a circuit for energizing the eastward detector relay ETDC which includes front contact g of relay 57MOP, back contact a of relay 20TR, front contact a of relay 24TR, and the winding of the relay. The train next occupies section 24T and the release of relay 24TR closes back contact a to complete a stick circuit for relay ETDC further including front contact h of relay 57MOP and front contact a of relay ETDC which bypasses back contact a of relay 20TR to hold relay ETDC energized when the train clears section 20T. The release of relay 24TR also completes an energizing circuit for relay ETP which includes front contact b of relay ETDC, front contact j of relay 57MOP, and back contact b of relay 24TR. The pickup of relay ETP completes to initial stick circuits, both of which originate at front contact b of relay ETDC. One further includes front contact j of relay 57MOP and front contact a of relay ETP while the second includes only front contact b of relay ETP. The first of the described circuits actually is a portion of an alternate energizing circuit for this relay under different conditions of manning of this particular station. A third stick circuit is completed when the train enters section 26T and includes back contact d of relay 57WTCCP, back contact c of relay 26TR, front contact k of relay 57MOP, and front contact b of relay ETP. When the train clears section 24T as it moves into the station track 26T, the opening of back contact a of relay 24TR deenergizes relay ETDC which releases at the end of its slow release period.

The circuit network for relays ETDC and ETP at station 57 is designed so that the system operation will continue when the station is unmanned, that is, no operator is present. For this reason, contacts of relay 57MOP are used to shift to alternate circuits which will be explained subsequently in this description. It may also be noted that a more simple circuit network is used at station 51 for the equivalent relays WTDC and WTP where it is assumed that an unmanned condition of the station is not contemplated. For example, when a westbound train enters station 51 under proper conditions, the release of relay 10TR, when the approach section is occupied, closes its back contact a to complete a circuit further including front contact a of relay 14TR to energize relay WTDC. Front contact a of this latter relay closes and completes a stick circuit also effective when back contact a of relay 14TR closes as the train occupies the switch detector section. At this time, the closing of back contact b of relay 14TR completes an energizing circuit for relay WTP which further includes front contact b of relay WTDC. This latter contact also supplies energy over front contact a of relay WTP for an initial stick circuit for this train repeater relay. A second stick circuit for relay WTP, to hold this relay energized after the train completes its movement into the station area, includes back contact c of of relay 16TR repeating the occupancy of the station track, back contact d of relay 51ETCCP, and front contact b and the winding of relay WTP. It is obvious that, when the train has cleared the approach section 10T and switch section 14T, relay WTDC is deenergized and releases since its stick circuit is interrupted.

Returning to the operation at station 57 with the eastbound train entering the station tracks, the pickup of relay ETP prepares, at its front contact d, a circuit for energizing the east train complete indication lamp ETCE, this circuit being completed when the train clears section 20T so that relay 20TR closes its front contact f, the circuit further including back contact c of relay 57WTCCP and lead 63. Having received this indication that the entering train has cleared the approach track section, and if the train is complete by his personal check, the station operator actuates the east train complete pushbutton ETCPB to close its contact a and thus complete a branch path for energizing the eastward train complete relay OETC. This relay closes its front contact a to complete a stick circuit further including lead 62 and back contact c of relay 57WTCCP to remain energized until the line circuit network is reset. With relays ETP and OETC now both picked up, alternate paths are completed to reconnect the westward line circuit to supply energy towards station 51. Tracing from lead 68, one side path includes front contact b of relay 57MOP, front contact c of relay OETC, front contact e of relay ETP, and front contacts d of relays 27LAS and 20TR to line wire 46. The other half of the circuit from lead 70 includes front contact c of relay 57MOP, front contact d of relay OETC, front contact f of relay ETP, and front contacts e of relays 27LAS and 20TR to line wire 47. With relay AW already released so that its back contacts b and c are closed, a third signal is now transmitted from station 57 to station 51, which has the usual at-rest polarity of this line circuit, i.e., line wire 47 positive.

Relay 51ETCC at station 51 is energized and, under the third signal polarity conditions, responds by picking up its reverse contacts. The closing of contact Ra of relay 51ETCC again reenergizes line repeater relay 51ETCCP which picks up. The closing of front contacts a and b of this latter relay reconnect the previously traced paths for the eastward line circuit and since relay 17RAS has picked up, the polarity of the energy supplied is such that relay 57WTCC at station 57 responds to pick up its reverse contacts in the usual manner. Further, relay 57WTCCP is also reenergized and picks up. With relay ETDC released when relay 24TR picks up, the opening of back contact d of relay 57WTCCP interrupts the remaining stick circuit for relay ETP and this relay releases. Although this opens the alternate circuit paths at this station for the westward line circuit, front contacts a and b of relay 57WTCCP are already closed to retain the line circuit connections complete over the usual, previously traced paths. Relay OETC releases when back contact c of relay 57WTCCP opens. The system is now restored to its normal or at-rest condition which it occupied prior to the movement of this train.

It will now be assumed that the operator at station 57 is not present, that is, that the station is unattended so that the operator at station 51 must work, communicate, and exchange signal authorities with the operator at the next station to the east of location 57. The station 57 operator, just prior to leaving, places his operator's lever in the OFF position so that relay 57MOP is deenergized and releases, closing its back contact a to energize the operator OFF indication lamp. This release also transfers the second or westward line circuit at contacts b and c of relay 57MOP from the usual connections to the line circuit source to source connections at front contacts a and b of relay 57ETCCP over normal back contacts a and b of relay 57ETCC and leads 69 and 71, respectively. Further, the usual line circuit branch paths over front contacts a and b of relay 57WTCCP are now open at front contacts d and e of relay 57MOP, as may be seen at the bottom of FIG. 1C. Rather, the two sides of the westward line circuit now extend from contacts b and c of relay 57MOP over back contacts m and n of this same relay, leads 72 and 73, front contacts c and d of relay 57ETCCP, leads 75 and 74, front contacts b and a of both relays 34TR and 26TR, and front contacts f and g of relay 24TR to the multiple paths over front contacts d and e of relays 24TR and 27LAS and thence to line wires 46 and 47 over front contacts d and e of relay 20TR. It is thus obvious that this westward line circuit now effectively repeats the polarity condition of the next line circuit from the east as established by the position of the contacts of relays 57ETCC and 57ETCCP, which function in the same manner as relays 51ETCC and 51ETCCP at station 51. At station 51, the line relay 51ETCC remains energized at the polarity which causes it to close its R contacts in the normal at-rest condition of the system. It is to be noted that the alternate paths just traced check that there is no eastbound train at station 57 occupying sections 20T, 24T, 26T, or 34T.

The local circuit network for the line circuit originating at and extending eastward from station 57 to the next eastward location differs from that shown at station 51 to supply polarized energy to line wires 48 and 49. At location 57, the eastward network is modified to be the reverse equivalent of the associated westward network just described. With relay 57MOP released, this eastward circuit is supplied with line energy over contacts of relays 57WTCCP and 57WTCC and includes front contacts of the track relays for sections 24T, 36T, 34T, and 30T. Since there is no change in the connections of relay 57WTCC to line wires 48 and 49, even with relay 57MOP released, the eastward circuit from station 57 will effectively repeat the polarity condition of the eastward line circuit from station 51. It will also be obvious that, with station 57 unmanned, the line circuits extending in both directions from this open location include checks as to the occupancy conditions of all track sections at location 57 so that the train movement through the open location cannot be established if any train is already occupying the station area.

It will now be assumed that the operator at station 51 desires to move a train eastward and operates signal lever 13-17GL to its R position to pick up relay 17RHS as previously described. This also deenergizes relay 17RAS which releases to pole-change the eastward line circuit also as previously described. At location 57, relay 57WTCC responds to this pole-changing of the line circuit energy to release its R contacts and pick up its N contacts. With relay 57MOP released, normal contacts of relay 57WTCC then pole-change the energy supplied eastward from station 57 in a manner equivalent to that illustrated at the bottom left of FIG. 1D at N contacts a and b of relay 57ETCC. This causes a reversal in the positioning of the contacts of the WTCC relay at the next station to the east causing the acknowledge lamp WAE at that location to light in a manner similar to that shown in FIG. 1D for the station 57 lamp. The operator at the next station east then actuates his acknowledge pushbutton, energizing relay AW at that location which picks up to pole-change the westward line circuit. At location 57, relay 57ETCC reverses position, closing its N front contacts. With relay 57MOP released, this pole-changes the westward line circuit as described and relay 51ETCC responds to pick up its N contacts and release its R contacts. It is be noted that between the eastward and westward line circuits all the track sections at location 57, over the back contacts of relay 57MOP, are checked as nonoccupied during these line circuit pole-changing actions. Signal relay 17H is now energized with front contact Nd of relay 51ETCC closed and signal 17G clears to authorize this eastbound train movement from station 51 through station 57 to the next station east.

When the eastward line circuit from station 51 is first pole-changed in setting up this eastbound train movement, relay ETDC at station 57 is energized. This energizing circuit includes back contact g of relay 57MOP, front contact Nf of relay 57WTCC, lead 76, back contact Nd of relay 57ETCC, lead 77, and the winding of relay ETDC. When the train movement request is eventually acknowledged from the station to the east, relay 57ETCC responds to the pole-changing of the line circuit from that station to close its front contact Nd to complete a stick circuit further including back contact h of relay 57MOP and front contact a of relay ETDC to hold this relay energized when relay 57WTCC releases as the train starts to move. Relay ETP at station 57 is then energized by the circuit extending from terminal B at front contact b of relay ETDC over back contact j of relay 57MOP, lead 78, front contact Nc of relay 57ETCC, and lead 79 to the winding of relay ETP and terminal N. Relay 23RHS, at the right of FIG. 1D, is energized at this time by a circuit originating in the interlocking circuitry and including front contact Ne of relay 57WTCC, back contact p of relay 57MOP, and front contact h of relay ETP. Energy is applied to the circuit to actuate the clearing of signal 23G into station 57 if the interlocking safety check circuits are complete to prove that safe conditions exist for such a train movement. Relay 23RHS, having slow release characteristics as indicated, will hold its front contacts closed when relay 57WTCC releases until the stick circuit is completed by back contact e of relay 57WTCCP over front contact h of relay 24TR.

Referring now to relay 27LHS at the right of FIG. 1D, it will be noted that an alternate circuit for energizing this relay is provided, with relay 57MOP released to close its back contact q and westbound traffic into station 57 established, including lead 66, interlocking circuits, front contact a of relay 33LHS, and back contact g of relay ETP at that location. Relay 27LHS would then be held by a stick circuit closed at its own front contact e, and further including front contact c of relay 24TR, back contact Rc of relay 57WTCC, back contact o of relay 57MOP, and lead 65. With the traffic established for the eastbound train from location 51 as described at this time, and relay 23RHS picked up, an equivalent alternate circuit is now completed for the RHS relay associated with signal 35G at location 57. With N front contacts of relay 57ETCC closed, a signal relay H associated with signal 35G is then energized to actuate a proceed indication on this eastbound signal from location 57. Thus when traffic is established through an unmanned station, the entry signal for that direction is cleared first and this actuates the clearing of the departure signal.

When this eastbound train accepts signal 17G and occupies section 14T at location 51, the release of track relay 14TR interrupts the eastward line circuit to station 57. Relay 57WTCC and shortly relay 57WTCCP release in a manner previously described. Back contact d of relay 57WTCCP completes a stick circuit including back contact k of relay 57MOP and front contact b of relay ETP to hold this relay energized. This stick circuit will thus maintain the registry of the eastbound movement through station 57. The stick circuit for relay 23RHS including back contact e of relay 57WTCCP has already been noted. The release of relay 57WTCCP, in a manner illustrated by contacts a, b, c, d of relay 57ETCCP in the lower left of FIG. 1D, interrupts the eastward line circuit from location 57. At the next station, the response of the line relay interrupts the westward line circuit in a manner previously described at location 57. At this location, relays 57ETCC and 57ETCCP are then deenergized and release to interrupt the line circuit to station 51 so that relays 51ETCC and then 51ETCCP release. This locks the line circuit networks between the end stations in the extended stretch and provides safety for this eastbound train movement since no opposing signals can be cleared into the stretch between station 51 and the next station to the east of 57. When this train eventually arrives at the first station east of location 57, the operator there registers the arrival of the complete train so that the associated relay OETC picks up and, as previously described, the line circuits are restored to their normal conditions. This clears out the established traffic for the eastbound train and the system returns to its at-rest condition. It may be noted that if any difficulty or fault occurs to prevent the restoring of the line circuits here or in any other situation, a reset pushbutton at station 51 is then actuated, closing its contacts a and b to apply energy from terminals LB and LN to the eastward line circuit from location 51 which energizes relay 57WTCC at that location to close its R front contacts and initiate a reset action.

If the operators at station 51 and 57 simultaneously request a train movement to the other station, relays 17RHS and 27LHS will both pick up when the corresponding signal levers are moved to the required positions. At station 51, the relay 17C normally picks up to repeat the pickup of relay 17RHS and the subsequent release of relay 17RAS, the circuit branching from the 17RHS circuit over front contact d of relay 17RHS and back contact h of relay 17RAS. Relay 17C is slow to pick up but closes its front contact c to bypass front contact Rb of relay 51ETCC prior to the pole-changing of the westward line circuit. This front contact c also sticks relay 17C since its other stick circuit including back contact j of relay 17RAS is presently open at back contact e of relay 17RHS. With simultaneous requests for signals and both AS relays released, both line circuits between stations 51 and 57 pole-change so that relays 57WTCC and 51ETCC reverse their positions almost simultaneously. At station 51, relay 17C is not completely picked up at this time so that relay 17RHS then releases upon the opening of front contact Rb of relay 51ETCC. Thus relay 17RHS is picked up only a short period and relay 17H is not sufficiently energized. A similar interaction occurs at station 57 between relays 27LHSR, 27C, and 57WTCC so that neither signal governing train movements into the single track stretch 55T may clear.

Relay 17C is also used to prevent a lock-out condition if both relays AE and AW inadvertently pick up and stick when a signal is manually returned to the stop indication. For example, if signal 17G has been cleared and then is returned by the operator to the stop indication, relay 17RHS releases when lever 13-17GL is returned to its center N position. Although back contact b of relay 17RHS is now closed, relay 17RAS remains released until a predetermined time period expires which is controlled conventionally by the interlocking safety check circuit network in a manner known in the art. Relay 17C, having picked up previously, is also held energized by the stick circuit including back contact j of relay 17RAS, back contact e of relay 17RHS, and its own front contact a. This relay is deenergized when back contact j of relay 17RAS opens but, having slow release characteristics, retains its front contacts closed for a predetermined time period. Any inadvertent operation of acknowledging pushbutton EAPB during this period, with relay AW at station 57 already held up, is not effective because back contact b of relay 17C is open even though front contact g of relay 17RAS has closed. This prevents the eastward line circuit from station 51 from remaining in a pole-changed condition at contacts b and c of relay AE when front contacts b and c of relay 17RAS reclose. Relay 57WTCC thus responds to the usual line circuit polarity to position itself to close its R front contacts. Relay 57WTCCP then picks up to restore the westward line circuit at its usual polarity and relay 51ETCC responds to restore the normal conditions at station 51. Subsequently, of course, relay AE cannot be energized and other conditions are also returned to the at-rest condition.

I shall now describe a second form of manual block traffic control and signal system which also embodies the invention. By placing FIGS. 2A and B adjacent, with FIG. 2A on the left, a composite illustration is provided of this second form of the control system, used between two stations along a stretch of single track railroad, with stations 51 and 57 at the left and right (west and east) ends, respectively. The communication channel between these two stations is comprised of line wires 52 and 53, which also join the two drawing figures.

Across the top of each figure is a schematic, single line representation of the track layout at the corresponding station location. These layouts are similar to those shown in FIGS. 1B and 1C in connection with the first form. Each consists of two parallel tracks approached from each direction by a single track. Between the two stations the single track, which is non-track circuited, is designated as section 55T. Again, as in the first form, insulated track sections are provided within the station area. For example, at station location 51 are the approach sections 2T and 10T, switch detector sections 4T and 14T, and passing track sections 6T and 16T. Each of these sections is provided with a train detector track circuit which is represented only by the corresponding track relay TR which is energized and picked up when the section is clear, i.e., not occupied. It is to be noted that a track relay for section 2T is not shown. The track switches, e.g., 5W and 15W at station 51, are conventionally marked as spring switches, normally positioned to route incoming trains to the right-hand passing track and through which departing trains may trail out into the single track. Each switch has an associated position and/or condition detector relay, e.g., relay 5WNP for switch 5W, which is picked up to indicate that the switch is positioned and locked normal but also free for a trailing movement from the other station track. Station 57 has a similar arrangement of track sections, switches, and associated track and switch detector relays. At each location, the composite non-occupancy of the station tracks, i.e., at and between the switches, is repeated by a single relay. For example, at station 51, station track repeater relay 51TP is normally energized by a series circuit through front contacts a of track relays 4TR, 16TR, 6TR, and 14TR. At station 57, relay 57TP repeats front contacts a of relays 24TR, 26TR, 36TR, and 34TR.

Each station is provided with departure and entry signals for each direction of traffic. For example, at the right or east end of station location 51 are the eastbound departure signal 17EG and westbound entry signal 13WG. At the west end are departure signal 7WG and entry signal 3EG. The signals are normally controlled by the station operator using signal levers shown below the track relay symbols. Signals 13WG and 17EG are associated with signal control lever 13-17GL. This is a three-position lever normally kept in its center or N position to hold the signals at stop and manually moved to its right (R) position to clear signal 17EG (in a manner to be described) and to its left (L) position to clear signal 13WG. The association and operation of the other signal levers is obvious from this brief description. Below each lever GL is a conventional circular symbol designating a contact controlled by that lever and closed only when the lever is in its N position and otherwise open. Similar symbols used elsewhere in the circuit diagrams and associated by reference to the controlling signal lever are closed only when the lever is in its L or R position, as marked by the letter within the circle symbol.

Figure 5:
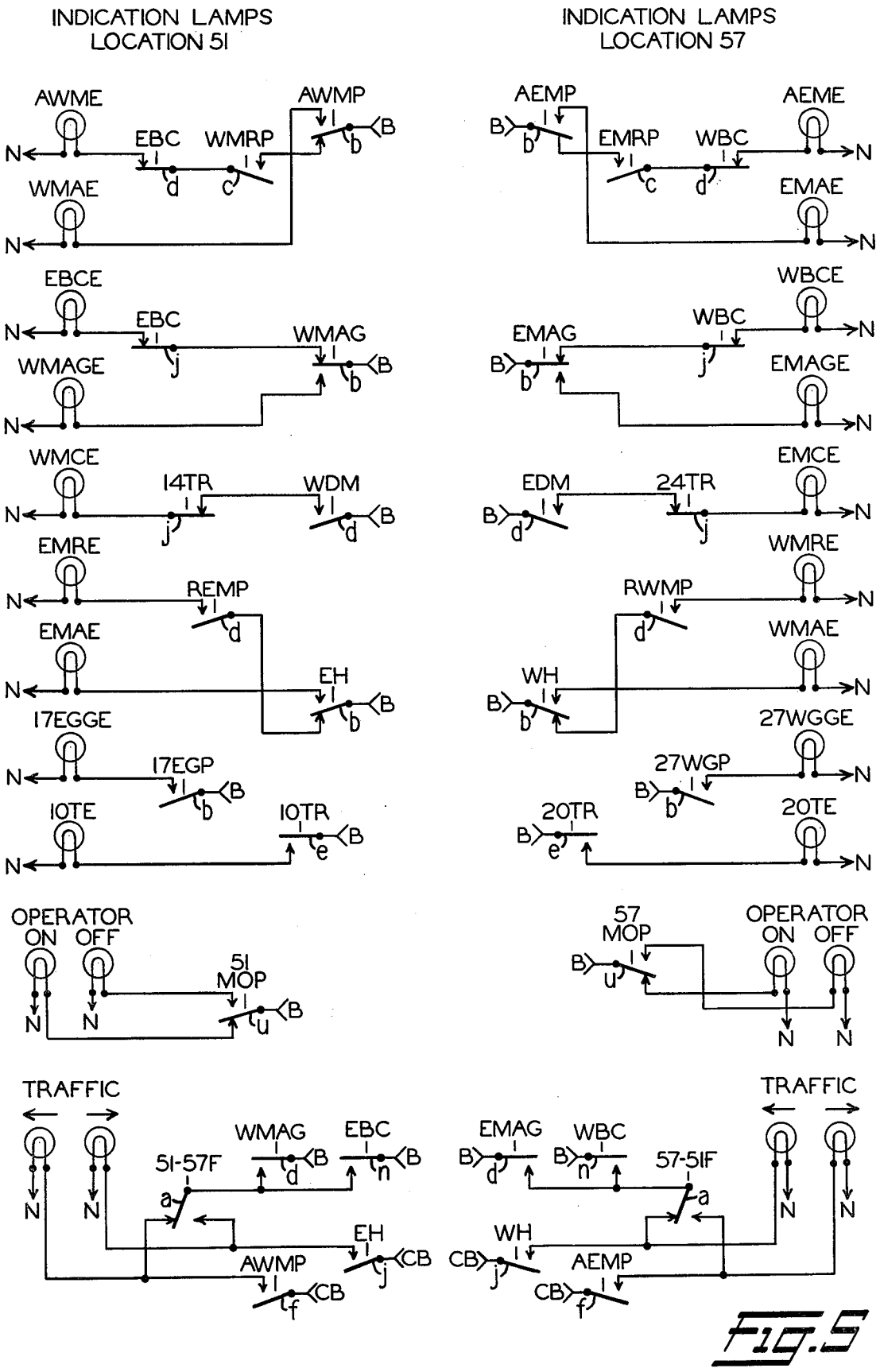
FIG. 5 shows control circuits for indication lamps which register system operation at the two stations illustrated in the various parts of FIGS. 2, 3 and 4.

Another manually operable lever, the two-position OPERATOR lever, is provided at each station to designate whether or not that station is manned. This lever is normally in its left (N) position when an operator is ON duty. The lever is manually moved to its R position by the operator if or when he goes OFF duty and leaves the station unmanned. This closes the R contact shown below the lever. Each OPERATOR lever is repeated by a manual operator repeater relay MOP, which is energized by moving the OPERATOR lever to its R position but only if the station and associated system circuit networks are at-rest. For example, the circuit for relay 51MOP is traced between source terminals B and N through an N contact of lever 13-17GL, the R contact of the associated OPERATOR lever, an N contact of signal lever 13-17GL, front contact a of relay 51TP, front contact a of west block clear relay 51WBC (winding not shown), front contact b of east block clear relay EBC, and the winding of relay 51MOP. This circuit checks both signal levers normal (no signals cleared or requested), station tracks not occupied, and single track blocks in each direction not occupied. A stick circuit over front contact a of relay 51MOP bypasses the track and block clear relay contacts. This stick circuit will hold relay 51MOP picked up, i.e., allows automatic operation of the station apparatus for through train movements, until the operator returns. On the station panel (FIG. 5), an ON indication lamp associated with the OPERATOR lever is normally lighted over back contact u of relay 51MOP. The associated OFF lamp is lighted over front contact u when the relay picks up.

Three pushbutton switches are provided (shown below the MOP circuit) for the operator to register selected actions. Each symbol designates a spring return pushbutton which closes or opens a contact only while that pushbutton or switch is held actuated. At station 51, pushbutton AWMPB is actuated by the operator to acknowledge a westbound request by the 57 operator. Switch WMCPB is actuated to confirm or register the arrival of a complete westbound train within the station area. The westward-move-not-complete pushbutton WMNCPB is actuated to initiate a system reset after special train moves or to cancel an established traffic direction. Similar pushbutton switches are provided at location 57, as may be observed and understood from the drawing symbols in FIG. 2B.

Figure 2A:
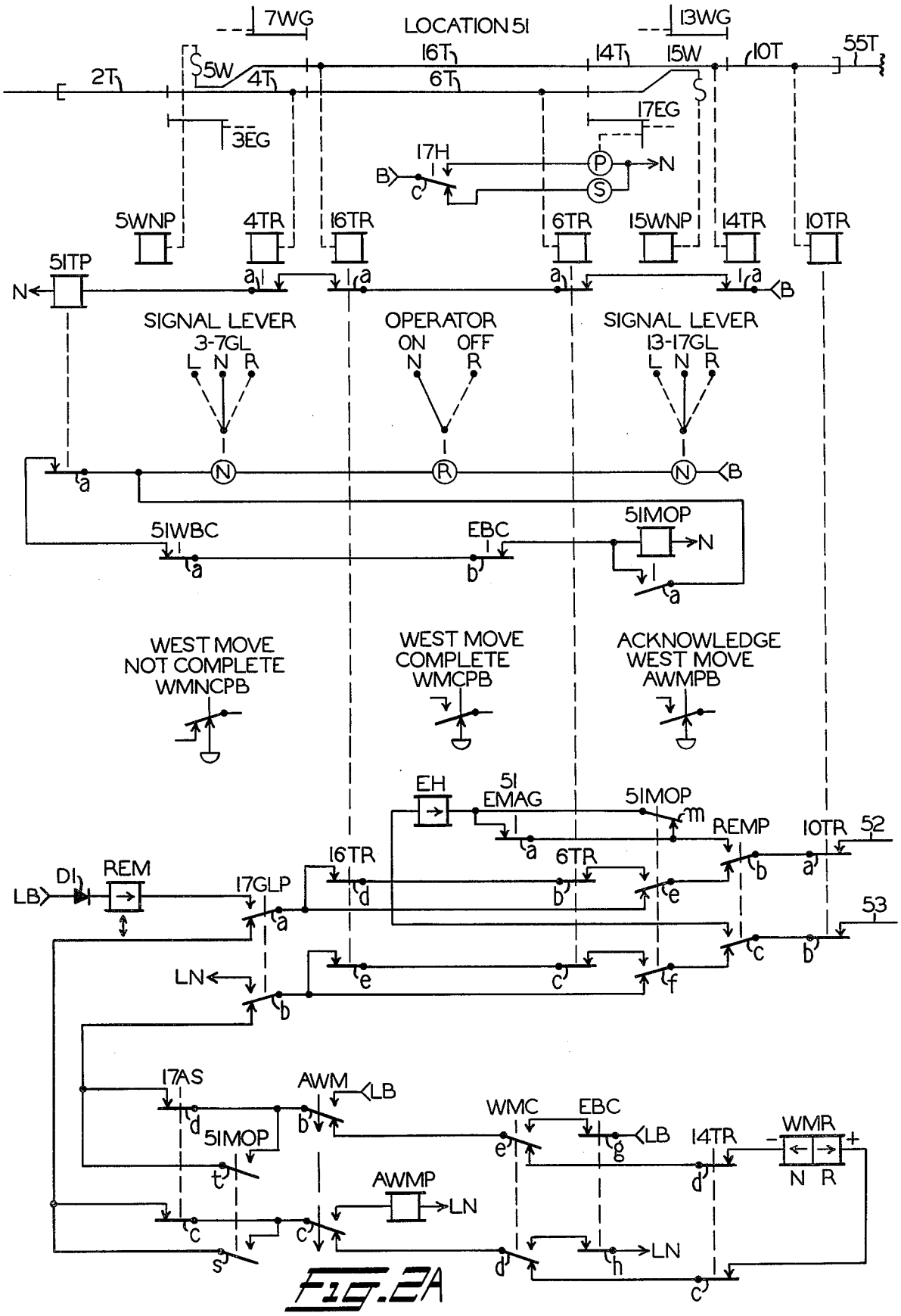
FIGS. 2A, B, taken together, illustrate partly schematically and partly by circuit diagram the interconnecting communication channel and partial controls for two adjacent stations along a single track railroad provided with a second form of manual block traffic control system also embodying my invention.
Figure 2B:
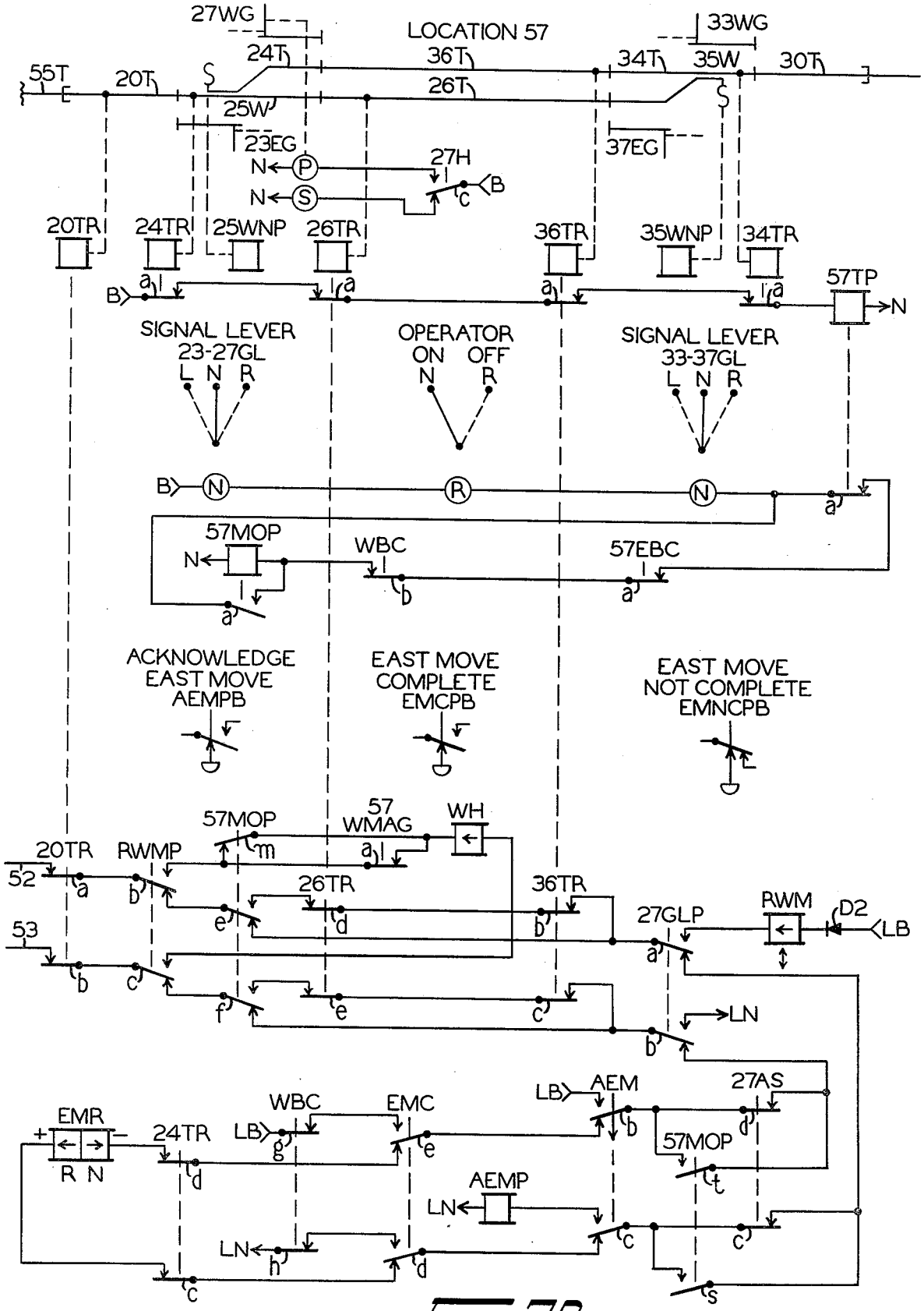

Across the bottom of FIG. 2A, B is the communication channel network by which the operators at stations 51 and 57 transmit requests, acknowledgements, and indications concerning train movements. In other words, this network functions to establish and release a requested traffic direction. Included in the channel are the line wires 52 and 53 extending between locations 51 and 57 so that, in effect, a two-wire, polarized line circuit is provided as compared with the four-wire line circuit of the first arrangement. Directly included in the line circuit network are the windings of east and west home relays EH and WH, request east and west movement relays REM and RWM, west and east move requested relays WMR and EMR, and acknowledge west and east movement repeater relays AWMP and AEMP. Relays WMR and EMR are biased, two-winding relays of the type previously described while relays EH, WH, REM, and RWM are biased relays which respond only to current flowing through the relay winding in the direction of the arrow. It will be remembered that relays of the EMR type each have two distinct sets of contacts N and R, one set responsive to each winding. Contacts of various track relays TR, the operator repeater relays MOP, and block clear relays BC, all already described, appear in the line circuit network. Other relays whose contacts are also involved will be discussed in the following description.

The system arrangement is best described by discussing its operation to establish a traffic direction and during the movement of the corresponding train. All apparatus is shown in the at-rest condition with an operator on duty at each station, no traffic direction established or signal cleared, and no train movement in progress. It will be noted that the line circuit is deenergized under these conditions since all connections to terminals LB and LN of the line circuit source are open at released front contacts of relays. Both relays MOP are deenergized and released.

Figure 3A:
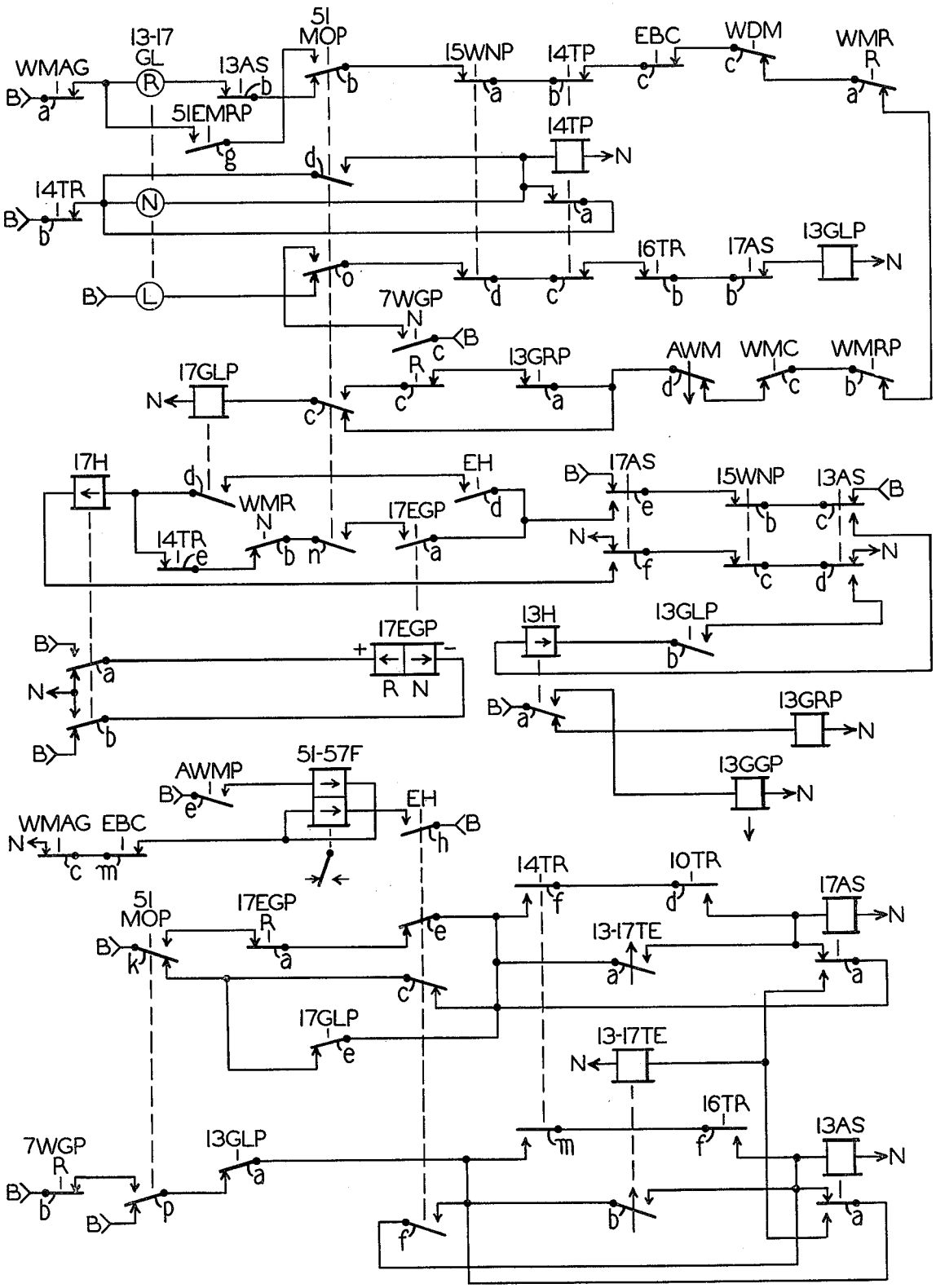
FIGS. 3A, B illustrate specific circuits for the apparatus illustrated at the station location in FIG. 2A.

It is now assumed that an eastbound train, occupying section 6T, is to be moved from location 51 to location 57. The released condition of relays 6TR and 51TP have no effect on this operation. To initiate the action, the 51 operator moves lever 13-17GL to its R position. If conditions are proper, as assumed, lever repeater relay 17GLP (FIG. 3A) is energized. The circuit may be traced beginning from terminal B at front contact b of relay WMAG which, when closed, indicates that no westbound movement has accepted a clear departure signal at station 57. The circuit continues over a now closed contact R of lever 13-17GL, front contact b of approach stick relay 13AS, which checks that no clearing of opposing signal 13WG is in progress, and back contact b of relay 51MOP. Next in the circuit is front contact a of relay 15WNP to check the proper condition of switch 15W, front contact b of relay 14TP, which primarily repeats the position of relay 14TR, to indicate section 14T unoccupied, front contact c of relay EBC which shows that single track section 55T is not occupied, back contact c of relay WDM closed when no westbound train is detected arriving at station 51, and reverse winding back contact Ra of relay WMR. The circuit continues over back contact b of repeater relay WMRP, back contact c of westbound movement complete relay WMC, back contact d of acknowledge west relay AWM which checks that no westbound movement has been accepted, back contact c of relay 51MOP, and the winding of relay 17GLP to terminal N. Digressing briefly, track repeater relay 14TP is normally held energized by the circuit including front contact b of relay 14TR and an N contact of lever 13-17GL. A stick circuit over its own front contact a bypasses the lever contact when a signal is to be cleared and holds the relay energized until the train occupies section 14T. This assures that the signal lever must be returned to normal before the track repeater again picks up and inhibits the automatic reclearing of signal 17EG after a train departs and clears section 14T. When the station is unmanned, so that front contact d of relay 51MOP is closed, relay 14TP acts as a direct front contact repeater of relay 14TR.

Returning to the signal clearing, relay 17GLP, thus energized, picks up to close its front contacts a and b and energize the line circuit from station 51, with relays REM and EMR in series. The circuit path is traced from terminal LB through diode D1, in its forward direction, and the winding of relay REM, over front contact a of relay 17GLP, back contact e of relay 51MOP, back contact b of repeater relay REMP, front contact a of relay 10TR, line wire 52, front contact a of relay 20TR, back contact b of relay RWMP, back contact e of relay 57MOP, back contact a of relay 27GLP, front contact c of relay 27AS, back contact c of relay AEM, back contact d of relay EMC, front contact c of relay 24TR, through both windings of relay EMR, returning over front contact d of relay 24TR, back contact e of relay EMC, back contact b of relay AEM, front contact d of relay 27AS, back contact b of relay 27GLP, back contact f of relay 57MOP, back contact c of relay RWMP, front contact b of relay 20TR, line wire 53, front contact b of relay 10TR, back contact c of relay REMP, back contact f of relay 51MOP, and front contact b of relay 17GLP to terminal LN. This circuit network checks that the approach sections at each end of single track 55T are clear, that no westbound move is requested, that an eastward move is not just entering station 57, and that signal 27WG has not been and is not being cleared. With all these conditions satisfied, a first signal is transmitted, from station 51, having a first polarity in which line wire 52 is positive, with respect to line wire 53. The flow of line current through relay EMR is proper for this relay to pick up its N contacts. Relay REM is also properly energized but has slow pick-up (and slow release) characteristics so that it does not immediately respond.

Meanwhile, relay EMRP (FIG. 4B) is energized by the closing of front contact Na of relay EMR, the circuit checking back contact a of relay AEMP closed and including back contact g of relay 57MOP and back contact a of a time element relay ETEA. When relay REM eventually closes its front contact a, relay REMP (FIG. 3B) is energized and picks up, the circuit also checking over front contact e of relay EBC that the east block is clear. Relay REMP is then held by its stick circuit completed by its own front contact a and including front contact e of relay EBC and at this time, front contact c of relay 17GLP. Contacts b and c of relay REMP shift the line circuit to connect the winding of relay EH to wires 52 and 53, over back contact m of relay 51MOP in parallel with front contact a of a relay 51EMAG associated with eastward moves into station 51. The opening of the corresponding back contacts b and c of relay REMP deenergizes the line circuit and thus relays REM and EMR. Relay REM, slow release, holds its front contact a closed to assure the complete pick up of relay REMP. This completes the first line circuit signal transmission and on the station 51 console or control panel, the eastward movement requested indication light EMRE (FIG. 5) is lighted by the closing of front contact d of relay REMP, the circuit also including back contact b of relay EH.

On the panel at station 57, the closing of front contact c of relay EMRP energizes the acknowledge eastward movement lamp AEME. This indication, which may also include an audible signal, requires the 57 operator to acknowledge, i.e., accept, the eastward train move request if agreeable to his operations. Relay EMRP holds energized, when relay EMR releases, over the stick circuit completed at its own front contact a which bypasses the EMR contact. The closing of front contact d of relay EMRP energizes, in multiple, two time element relays ETEA and ETEB, each with a preselected timing period with that of relay ETEB being somewhat longer. Thus, the registry of the eastward movement request is of limited time duration. In other words, the 57 operator must respond to this block request within the time period set by relay ETEA. The 51 operator also knows that, if his request is not acknowledged within this time period, the other operator was not in a position to acknowledge the request or was not in agreement. The 51 operator must return his lever 13-17GL to its N position and then again repeat his request. This time period enables a reset of the system, following a request for a move in one direction, to enable a request for a move in the opposite direction to be transmitted, e. g., for a priority train.

Assuming he agrees with the request, the 57 operator actuates his acknowledge eastward movement switch AEMPB (FIG. 4B) to close its contact a. This energizes his acknowledge eastward movement relay AEM over back contact h of relay 57MOP, front contact e of relay EMRP, and front contact f of relay WBC to check that the west block (from 51) is clear. Relay AEM picks up and its front contacts b and c (FIG. 2B) reenergize the line circuit including relays AEMP and EH in series. With terminal LB now connected over front contact b of relay AEM and a portion of the previously traced circuit to line wire 53, the line circuit is now energized at the opposite polarity to transmit this second or acknowledge signal from station 57. Current flow through relay EH at station 51 is in the proper direction and both this relay and relay AEMP pick up. The opening of back contact a of relay AEMP interrupts the stick circuit for relay EMRP which releases. Front contact c of relay AEMP completes the stick circuit for relay AEM further including normally closed contact a of switch EMNCPB, back contact j of relay 57MOP, front contact a of relay AEM, and front contact f of relay WBC. At station 57 (FIG. 5), the shift of contact b of relay AEMP lights eastward movement acknowledged lamp EMAE and extinguishes lamp AEME. At station 51, the closing of front contact b of relay EH lights the eastward movement acknowledged lamp EMAE and extinguishes the request lamp EMRE.

Also at station 51 (FIG. 3A), with back contact e of relay 17GLP already open, the opening of back contact c of relay EH interrupts the normally active stick circuit for relay 17AS which releases. This energizes biased signal relay 17H over the circuit including front contacts c and d of relay 13AS, front contacts b and c of relay 15WNP, back contacts e and f of relay 17AS, front contact d of relay EH, and front contact d of relay 17GLP. Current flow is proper so that relay 17H picks up and closes its front contact c to operate signal 17EG to display a proceed (clear) indication. Contacts a and b of relay 17H pole-change the energy applied to signal repeater relay 17EGP so that its R contacts release and N contacts pick up to repeat the clear or proceed signal aspect. On panel 51 (FIG. 5), front contact Nb of relay 17EGP lights the green signal indication lamp 17EGGE.

The train in section 6T now accepts the proceed indication on signal 17EG and enters section 14T. The release of relay 14TR to open its front contacts c and d further interrupts the line circuit paths to relay WMR, previously opened at front contacts c and d of relay 17AS. Front contact b of relay 14TR opens the stick circuit for relay 14TP which releases, opening its front contact b to deenergize relay 17GLP. Front contact d of this relay opens the circuit for relay 17H which releases to place signal 17EG at stop. Contacts a and b of relay 17H restore the reverse polarity energy to relay 17EGP so that its R contacts again pick up, with the release of front contact Nb extinguishing lamp 17EGGE. Back contacts a and b of relay 17GLP in the line circuit close but the network beyond is open.

When the train occupies section 10T, relay 10TR releases and opens its front contacts a and b to completely interrupt the line circuit network at wires 52 and 53. This terminates the second signal being transmitted over the line circuit, deenergizing relays EH and AEMP which release. With front contact c of relay 17GLP already open, front contact a of relay EH opens the stick circuit for relay REMP which releases. Relay EH, at its front contact b, also extinguishes the east movement acknowledged lamp EMAE. At station 57, front contact c of relay AEMP interrupts the stick circuit to deenergize relay AEM. However, relay AEM is sufficiently slow release to hold its back contact e open in the stick circuit network which normally energizes eastward movement accepted signal relay EMAG (FIG. 4B) until front contact d of relay AEMP has fully opened. Relay EMAG is thus deenergized long enough to overcome the release time provided by the resistor snub on its winding, which holds this relay picked up during the pick up cycle of relays AEM and AEMP. Relay EMAG therefore releases at this time and its contact b extinguishes west block clear lamp WBCE on the 57 panel (FIG. 5) and lights lamp EMAGE to inform the 57 operator that the train has accepted the signal and has entered the single track. It is to be noted that normally energized relay WBC remains energized by its stick circuit over front contact c of relay 20TR. However, at station 51, east block clear relay EBC (FIG. 3B) is deenergized by the opening of front contact c of relay 10TR and releases. Front contact j of relay EBC extinguishes the east block clear lamp EBCE on station 51 panel to indicate occupancy of section 55T. Even though section 55T is not track circuited and thus there is no direct train detection, the continued release of relay EBC protects this eastward train movement by its open front contacts in the line circuit network at station 51 and in the circuits for relays 17GLP, AWM, and REMP.

Figure 4A:
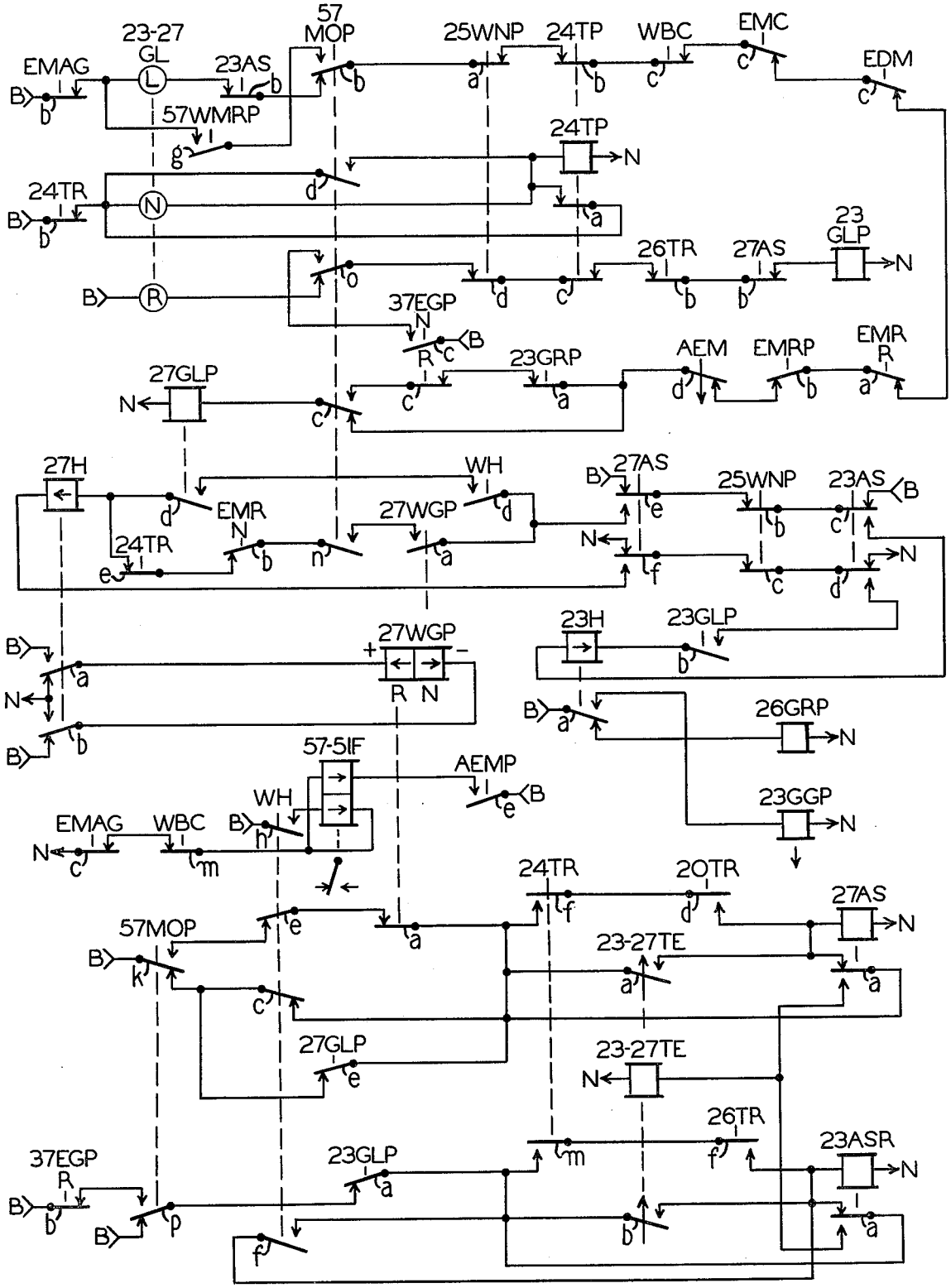
FIGS. 4A, B show specific circuits for the apparatus illustrated at the station location in FIG. 2B.

When relays 14TR and 10TR release, together with relays 17GLP and/or EH, relay 17AS (FIG. 3A) is reenergized. This circuit extends from terminal B at back contact k of relay 51MOP over back contact e of relay 17GLP in multiple with back contact c of relay EH, back contact f of relay 14TR, back contact d of relay 10TR, and the winding of relay 17AS to terminal N. Front contact a of relay 17AS completes the stick circuit which bypasses the contacts of the track relays when the train clears sections 14T and 10T. This is the normal action to restore relay 17AS to its normal picked-up condition. If for any reason the signal is returned to stop before the train accepts it, a circuit is completed including back contact k of relay 51MOP, back contact e of relay 17GLP, and back contact a of relay 17AS to energize time element relay 13-17TE which has a safety timing period measured normally in minutes before it closes front contacts. The eventual closing of front contact a of relay 13-17TE will then reenergize relay 17AS. It will also be noted that, as soon as the 51 operator restores lever 13-17GL to its N position and the train has cleared section 14T, relay 14TP will be energized and picked up to complete its stick circuit. To be noted at this time are the traffic direction indication relays 51-57F at station 51 (FIG. 3A) and 57-51F at station 57 (FIG. 4A). Each relay is of the two winding, magnetic stick type. As illustrated by the single example immediately below each winding symbol, contacts of such relays are shown with the movable armature vertical. Current flow through either winding in the direction of the arrow actuates the relay to operate its contacts to close in the left hand or normal position. Conversely, flow of current opposing the arrow causes the contacts to operate to the right-hand or reverse position. With both windings deenergized, the contacts remain in the position to which last operated. When relay EH picks up in response to the second line circuit signal, its front contact h energizes the lower winding of relay 51-57F if relays WMAG and EBC are both still picked up to close front contacts c and m, respectively. The flow of current opposes the arrow so that relay 51-57F operates its contacts reverse. At the same time, the upper winding of relay 57-51F is energized by the closing of front contact e of relay AEMP, if front contacts c and m of relays EMAG and WBC, respectively, are closed. Contacts of relay 57-51F close in the reverse position. When relays EMAG and EBC release as the train departs station 51 and occupies section 10T, both traffic relays are deenergized and their contacts hold reverse. On the panel at station 51, the eastbound traffic lamp (lower left of FIG. 5 with right pointing arrow) is lighted, as a flashing indication, from coded source terminal CB over front contact j of relay EH. This indication signifies that eastward traffic is established. A steady indication is displayed when the train departs and relay EBC releases, closing the circuit including its back contact n and reverse contact a of relay 51-57F. At station 57, a flashing eastward traffic indication is activated when front contact f of relay AEMP closes. The steady indication displayed over back contact d of relay EMAG and reverse contact a of relay 57-51F informs the 57 operator that an eastbound train occupies the single track 55T.

As the train approaches station 57, it occupies section 20T and relay 20TR releases. As shown at the bottom right of FIG. 5, back contact e lights the track occupancy lamp 20TE to inform the 57 operator that the eastbound train previously indicated by his traffic lights is closely approaching. The opening of front contact c of relay 20TR deenergizes relay WBC which releases so that its front contact j further interrupts the lamp WBCE circuit. At this time or previously, the 57 operator clears signal 23EG to authorize the train to enter the station through section 24T into section 26T. He moves lever 23-27GL to its R position (FIG. 4A), energizing relay 23GLP over back contact o of relay 57MOP, front contact d of relay 25WNP, front contact c of relay 24TP, front contact b of relay 26TR, and front contact b of relay 27AS, these last four contacts representing usual interlocking safety checks. When relay 23GLP picks up, its back contact a interrupts the stick circuit for relay 23AS which releases. The closing of back contacts c and d of relay 23AS completes the energizing circuit for relay 23H, further including front contacts e and f of relay 27AS, front contacts b and c of relay 25WNP, and front contact b of relay 23GLP. Relay 23H picks up to clear signal 23EG (circuit not shown) and its contact a deenergizes the red signal repeater relay 23GRP and energizes the green signal repeater relay 23GGP.

When the train accepts signal 23EG and enters section 24T, relay 24TR releases followed by relay 24TP. Front contact c of this latter relay deenergizes relay 23GLP which is subsequently held deenergized by front contact b of relay 26TR. Relay 23GLP releases, followed by relay 23H to place signal 23EG to stop. Relay 23GRP picks up and relay 23GGP is deenergized and eventually releases at the end of its slow release period. Meanwhile, eastward direction movement relay EDM (FIG. 4B) is energized over front contact a of relay 23GGP, back contact g of relay 24TR, and back contact k of relay WBC. Relay EDM closes front contact a to complete a stick circuit including back contact k of relay WBC and, at first, back contact h of relay 24TR and then back contact c of relay 26TR. When relay 24TR picks up after the train clears into track 26T, the eastward movement complete lamp EMCE is lighted, over front contacts d and j of relays EDM and 24TR, respectively, to instruct the 57 operator that he should acknowledge or confirm the arrival of the complete train.

Figure 4B:
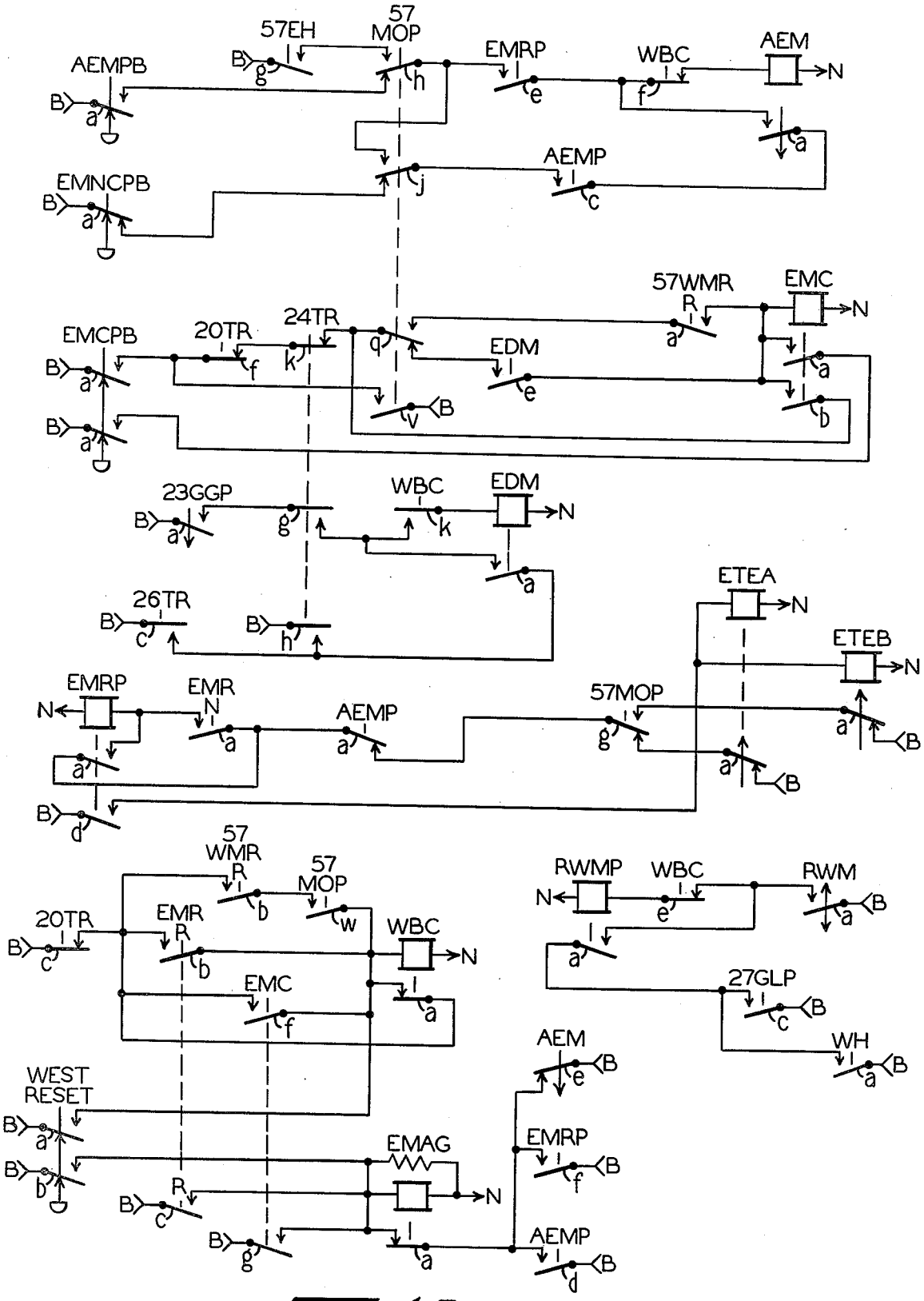

Operator 57 now pushes and holds momentarily eastward movement complete switch EMCPB to close its contacts a and b (FIG. 4B). This energizes eastward movement complete relay EMC by the circuit traced from terminal B over closed contact a of switch EMCPB, front contacts f and k of relays 20TR and 24TR (checking that the train has cleared into station track 26T), back contact g of relay 57MOP, front contact e of relay EDM (checking that an eastward movement was detected), and the winding of relay EMC to terminal N. Relay EMC picks up and holds over a stick circuit including its front contact a and contact b of switch EMCPB as long as it is held closed. A second stick circuit also exists but at this time also includes an EMCPB contact. The closing of front contact f of relay EMC, with front contact c of relay 20TR closed, reenergizes relay WBC which picks up and sticks in the normal manner over the 20TR contact. Front contact g of relay EMC energized relay EMAG which then sticks over back contact e of relay AEM. On the station 57 panel (FIG. 5), lamp EMAGE is extinguished and west block clear lamp WBCE is relighted, which indicates the single track, i.e., sections 10T, 55T, and 20T is clear or unoccupied. The eastward traffic lamp is also extinguished by the pick up of relays EMAG and WBC.

With relays WBC and EMC picked up, the line circuit is again energized from station 57 to transmit a third or reset signal to relay WMR at station 51. The completed network includes front contacts g and h of relay WBC (connected to terminals LB and LN, respectively), front contacts e and d of relay EMC, back contacts b and c of relay AEM, front contacts d and c of relay 27AS, back contacts b and a of relay 27GLP, back contacts f and e of relay 57MOP, back contacts c and b of relay RWMP, front contacts b and a of relay 20TR, line wires 53 and 52, front contacts b and a of relay 10TR, back contacts c and b of relay REMP, back contacts f and e of relay 51MOP, back contacts b and a of relay 17GLP, front contacts d and c of relay 17AS, back contacts b and c of relay AWM, back contacts e and d of relay WMC, front contacts d and e of relay 14TR, and both windings of relay WMR. This line network checks that no improper apparatus condition or train occupancy exists which should inhibit reset. With terminal LB connected to wire 53, this third or reset signal has the same polarity as the second signal and relay WMR is so energized as to pick up R contacts. Front contact Rb of relay WMR closes to reenergize relay EBC (FIG. 3B) which sticks in the usual manner over front contact c of relay 10TR. On the panel at station 51, light EBCE is again lighted over front contact j of relay EBC and front contact b of relay WMAG and the eastward traffic lamp is extinguished by the opening of back contact n of relay EBC. The 57 operator may now release switch EMCPB. This releases EMC which interrupts the supply of energy to the line circuit and thus terminates the transmission of this third signal. Relay WMR releases. The line circuit is now restored to its normal deenergized condition and the at-rest system is ready to establish another train movement in either direction.

If after clearing signal 17EG, it becomes necessary to restore it to a stop indication prior to a train movement, the 51 operator returns lever 13-17GL to its N position. This interrupts the circuit for relay 17GLP at the lever R contact and this relay releases to deenergize relay 17H to restore the signal to stop. Relay 17AS remains released since back contacts f and d of relays 14TR and 10TR are open. However, the closing of back contact e of relay 17GLP energizes relay 13-17TE, as previously discussed, and this time element relay begins its timing period which may be on the order of two to five minutes. Relay 17AS will be reenergized and pick up at the expiration of this timing period, as previously explained. Meanwhile, the line circuit remains energized with the second signal transmitted from station 57 over front contacts b and c of relay AEM. In other words, the block remains acknowledged and eastward traffic direction established, with relays AEMP and EH picked up. If signal 17EG is not to be recleared, then the 57 operator is instructed to operate the eastward movement not complete pushbutton EMNCPB to open its contact a. This interrupts the AEM relay stick circuit and the relay releases, at the end of its slow release period, to open front contacts b and c to deenergize the line circuit. Relays AEMP and EH then release. Relay REMP shortly releases, when front contact a of relay EH opens, but since relay 17GLP has already released, the line circuit remains deenergized. Relay EMAG remains energized, since its resistor snub retains the relay up during contact transfer times of relays AEM and AEMP. The system is now reset.

If the train cannot stop in time and overruns signal 17EG after it is put to stop and enters section 14T, the train is protected from any attempt to clear signal 13WG by the released condition of relay 17AS during the timing period of relay 13-17TE and by the open front contact c of relay 14TP in the circuit for relay 13GLP. It is also protected from westward traffic by open front contacts c and d of relay 14TR in the line circuit path to relay WMR. If the train overruns into section 10T, relay EBC is also released to provide additional protection. Under these conditions, when the train pulls back into section 6T and clears sections 10T and 14T, the EAST RESET pushbutton (FIG. 3B) will have to be actuated to reenergize relay EBC to restore the system to normal. This RESET pushbutton is also used to reenergize relays EBC and WMAG if a power outage should occur at station 51.

Assume now that the train in section 6T for which eastward traffic has been established is to move into the single track (sections 10T and 55T) and then reverse and return into station track 16T. As the train accepts the clear signal 17EG and moves eastward, the system responds in the same manner as for any eastbound train, just as previously described. When the train clears section 14T, the 51 operator initiates the clearing of signal 13WG for the reverse move by moving lever 13-17GL to its L position. Since relay 17AS has by now picked up, relay 13GLP (FIG. 3A) is energized by the circuit including the L contact of lever 13-17GL, back contact o of relay 51MOP, and front contacts d, c, b, and b of relays 15WNP, 14TP, 16TR, and 17AS, respectively. Relay 13GLP picks up and its back contact a interrupts the stick circuit for relay 13AS which releases. With front contact b of relay 13GLP closed, the closing of back contacts c and d of relay 13AS completes the circuit for energizing signal relay 13H. This relay picks up to clear signal 13WG (circuit not shown) and, at its contact a, to energize relay 13GGP and release relay 13GRP, the green and red repeaters of signal 13WG. Two relays are used, rather than a single relay such as relay 17EGP, since system reset requires slow release characteristics for the green repeater.

Figure 3B:
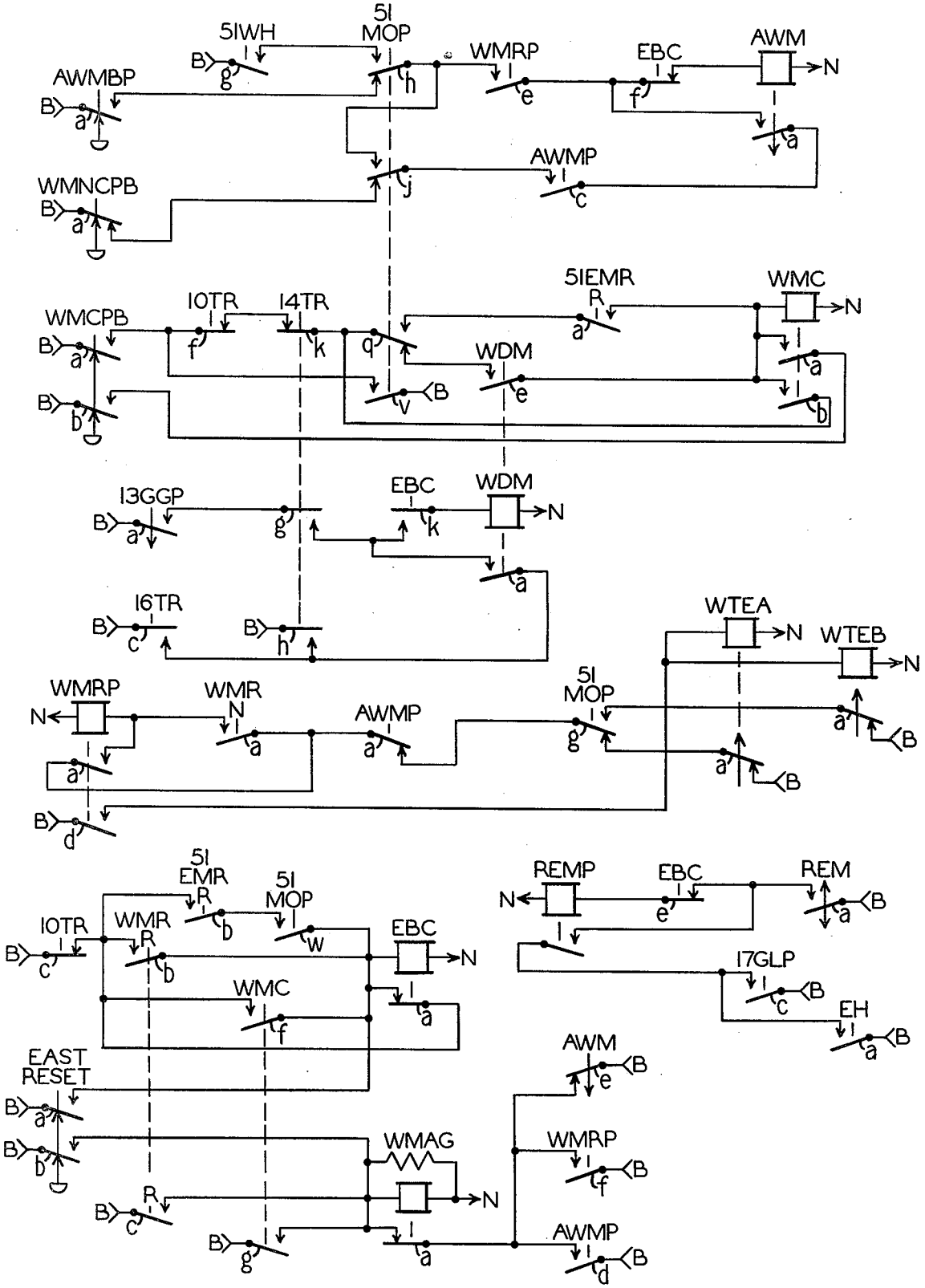

The train accepts the clear 13WG signal and moves back into section 14T and thence into section 16T. Release of relay 14TR energizes west direction movement relay WDM (FIG. 3B). Although relays 13GLP, 13H, and 13GGP are deenergized in sequence by the opening of front contact c of relay 14TP, front contact a of relay 13GGP remains closed long enough for back contact g of relay 14TR to close in the circuit for relay WDM, back contact k of relay EBC having previously been closed. Back contact h of relay 14TR, later back contact c of relay 16TR, and front contact a of relay WDM then hold this latter relay energized. When the train clears section 14T, lamp WMCE is lighted over front contact d of relay WDM and front contact j of relay 14TR to direct the operator to confirm the arrival of the train into his station. The 51 operator accordingly actuates pushbutton WMCPB and holds it momentarily. With contact a of pushbutton WMCPB now closed, and relays 10TR, 14TR, and WDM picked up, relay WMC is energized and picks up to complete stick circuit closed as long as the pushbutton is held actuated. When front contact f of relay WMC closes, relay EBC is energized, picks up, and holds over front contact c of relay 10TR. Since relay WMAG is normally energized, lamp EBCE is lighted on the station 51 panel. The opening of back contact k of relay EBC deenergizes relay WDM.

With front contacts d and e of relay WMC and front contacts g and h of relay EBC closed, the line circuit is energized from station 51, with terminal LB connected to wire 53 to transmit a reset signal. At station 57, with relay AEM released, the reset signal transmitted from station 51 energizes relay EMR with the polarity to pick up its R contacts. The closing of front contact Rc of relay EMR reenergizes relay EMAG which picks up and sticks over back contact e of relay AEM, the normal condition. Lamp EMAGE is extinguished and lamp WBCE lighted. When the 51 operator releases pushbutton WMCPB, relay WMC releases, the line circuit is deenergized, and relay EMR releases. The system is now reset and ready for another move.

It is now assumed, with the system at-rest, that the operator at station 57 is to go off duty, leaving the station unmanned. Control of train movements through the single track will then rest with the operators at station 51 and the next station east of station 57, e.g., for ease of later reference, a station 91. When ready to leave, operator 57 places his OPERATOR lever in its R position. If the station is inactive with both signal levers in their N positions, all station track sections are unoccupied so that relay 57TP is picked up, and no train occupies the single track in either direction so that front contacts of relays WBC and 57EBC are closed, relay 57MOP is energized. This relay picks up and holds with its stick circuit checking only the signal and operator levers unchanged. All front contacts of relay 57MOP are now closed, all back contacts open, and station 57 is in automatic operation.

The operator at location 51 now initiates an eastbound move and transmits his request to the operator at location 91. Operator 51 moves lever 13-17GL to its R position which energizes relay 17GLP, as previously described, if all conditions are proper. Front contacts a and b of relay 17GLP energize the line circuit to transmit the first signal with relays REM and EMR in series. It may be noted that, at station 57, with front contacts e and f of relay 57MOP closed, front contacts d and e of relay 26TR and b and c of relay 36TR are included in the network to check the absence of any train within station 57. This is a necessary added safety check since the requested movement, i.e., established traffic direction, is for the entire distance to station 91. Also front contacts s and t of relay 57MOP are in parallel with front contacts c and d, respectively, of relay 27AS. Relay EMR picks up its N contacts and relay EMRP is energized, picks up, and now with front contact g of relay 57MOP closed, sticks over back contact a of time element relay ETEB which is energized to begin its timing period when front contact d of relay EMRP closes. Relay ETEB has a somewhat longer timing period than relay ETEA to allow for the additional system actions now necessary.

At the east end of station 57, a relay 37GLP is now energized. Using the circuit network for relay 17GLP (top of FIG. 3A) as an equivalent example, with front contact b of relay 51MOP closed, and if no westbound train is approaching so that front contact b of relay WMAG is closed, the closing of front contact g of relay 51EMRP applies energy from terminal B to the circuit for relay 17GLP. If all local conditions are proper, now including, over front contact c of relay 51MOP, front contact a of relay 13GRP and front contact Rc of a relay 7WGP associated with signal 7WG, relay 17GLP is energized and remains so for the timing period of relay ETEB. Similarly, relay 37GLP picks up and the line circuit to station 91 is energized with associated relays 57REM and 91EMR in series. Relay 91EMR picks up its N contacts and relay 91EMRP is energized to light the lamp AEME at location 91. At locations 51 and 57, the slow acting REM relays then pick up, energizing the associated REMP relays which pick up their contacts b and c to deenergize the corresponding line circuit and connect the associated relay EH to the line wires.

The operator at station 91 now operates his pushbutton AEMPB to acknowledge the eastward movement request and his acceptance of the train. As described previously for station 57, this energizes the associated relay AEM which picks up to reenergize the line circuit to station 57 at the opposite polarity. This action at station 91 must occur within the timing period of the corresponding timing relay 91ETEA so that relay 91EMRP is still held energized. At station 57, this reverse polarity signal from station 91 energizes relay 57EH, similar to relay EH at station 51. By referring to relay EH on FIG. 2A, it will be seen that, with relay 57MOP picked up, the line circuit network through relay 57EH is complete only if relay EMAG at station 57 is picked up to check that no east bound train is approaching through section 55T. With front contact h of relay 57MOP closed, and if relay EMRP is still held energized (relay ETEB not yet picked up), the closing of front contact g of relay 57EH energizes relay AEM to repeat the acknowledgement signal from station 91. The line circuit to station 51 is now reenergized with opposite polarity over front contacts b and c of relay AEM. With relay REMP at station 51 held energized, relays AEMP and EH are energized and pick up. As previously described, this clears signal 17EG to authorize the eastbound train movement.

At station 57, relay AEM is held energized by a stick circuit completed as before over front contact c of relay AEMP but now including front contacts h and j of relay 57MOP and front contact g of relay 57EH. With station 57 in automatic mode, the pick-up of relay 57EH deenergizes an approach stick relat 37AS associated with eastward signal 37EG. Referring to the circuit network for relay 17AS (FIG. 3A) as typical, it will be seen that, with front contact k of relay 51MOP closed, the opening of back contact e of relay EH will interrupt the stick circuit and deenergize relay 17AS. Similar to the previously described operation, the release of relay 37AS at station 57 energizes signal relay 37H (equivalent of relay 17H, FIG. 3A) and signal 37EG clears. Referring to relay 17H as typical, the pick up of this relay polechanges the energy supplied to relay 17EGP which then picks up its N contacts. With front contact n of relay 51MOP closed, the closing of front contact Na of relay 17EGP establishes an equivalent stick circuit path for relay 17H, further including back contact Nb of relay WMR and front contact e of relay 14TR and extending between back contact e of relay 17AS and the winding of relay 17H. At station 57, the corresponding stick circuit is effective at this time to hold relay 37H energized when relay 37GLP is deenergized by the release of the associated relay 57EMRP, when relay ETEB completes its timing period and picks up. Also at station 57, with front contact o of relay 57MOP now closed, the closing of front contact Nc of relay 37EGP energizes relay 23GLP. With front contact p of relay 57MOP closed, the opening of front contact Rb of relay 37EGP deenergizes relay 23AS. Relay 23H is then energized, as previously described, and signal 23EG clears. Both eastbound signals at station 57 are now cleared in anticipation of the arrival of the eastbound train for which eastward traffic is established from station 51 to station 91.

When the eastbound train accepts clear signal 17EG and enters section 14T, relays 14TR, 14TP, 17GLP, and 17H release to place the signal at stop. When next relay 10TR releases, the line circuit to station 57 is deenergized and relays EH and AEMP release. As previously described, relay AEM is deenergized but holds until relay EMAG (FIG. 4B) releases after relay AEMP interrupts its stick circuit.

Referring now to FIG. 2A for a typical line circuit arrangement associated with the east end of any station, it is noted that, with back contact m of relay 51MOP open, the release of relay 51EMAG, at its front contact a, interrupts the line circuit. At station 57 at this time, release of relay EMAG thus interrupts the line circuit to station 91. The relay 57EH thus releases but relay 37H is held energized by the above described stick arrangement involving front contact Na of the associated relay 37EGP. The action at station 91, with the line circuit deenergized, is the same as the normal operation previously discussed at station 57 when manned. That is, the corresponding relay AEMP releases, followed eventually by the release of relay AEM. Meanwhile, the relay 91EMAG is deenergized to indicate the entry of the train at station 51 into the stretch.

When this train moves through the station 57 layout, the signals are returned to stop by track section occupancy. For example, relay 23GLP is deenergized when front contact c of relay 24TP opens and is then held deenergized by open front contact b of relay 26RT. By the time relay 26TR again picks up, the 23GLP circuit is open at front contact Nc of relay 37EGP. The opening of front contact b or relay 23GLP deenergizes relay 23H whose release places signal 23EG to stop. Since relay 37GLP has previously released, the opening of front contact e of relay 34TR interrupts the stick circuit path for relay 37H (see relay 17H on FIG. 3A) which releases to return signal 37EG to its stop position. With front contact p of relay 57MOP closed, the energizing circuit for relay 23AS over back contacts a, m, and f of relays 23GLP, 24TR, and 26TR, respectively, is open at front contact Rb of relay 37EGP when the train enters the station. Thus relay 23AS does not pick up at this time. When the train departs from station 57, relay 37AS eventually picks up. Referring to the circuit for relay 17AS (FIG. 3A) as typical, with front contact k of relay 51MOP closed, the energizing circuit for relay 17AS is over front contact Ra of relay 17EGP, back contact e of relay EH, and back contacts f and d of relays 14TR and 10TR, respectively. This circuit is completed only when relay 17EGP closes its front contact Ra. Relay 37AS thus is energized when relay 37EGP picks up its R contacts as a result of signal 37EG returning to stop. At the same time, front contact Rb of relay 37EGP also closes and energizes relay 23-27TE (FIG. 4A) over front contact p of relay 57MOP, back contact a of relay 23GLP, and back contact a of relay 23AS. When relay 23-27TE completes its timing period and closes its front contact b, relay 23AS is energized and picks up. This delay in restoring relay 23AS is not critical since no other train can be moved through station 57 at this time.

When the train arrives at and enters station 91, its entry is detected and/or registered in the manner previously discussed for station 57. The 91 operator takes the normal action, when the train arrival is complete, of operating pushbutton EMCPB. With relay 91EDM picked up. the closing of EMCPB contacts energizes relay 91EMC. Its front contacts d and e supply energy to the line circuit as typically illustrated in FIG. 2B. At station 57, the applied line circuit energy causes relay 57WMR (see FIG. 2A) to pick up its R contacts. Relay EMC (FIG. 4B) is now energized over front contact v of relay 57MOP, front contacts f and k of relays 20TR and 24TR, front contact g of relay 57MOP, and front contact Ra of relay 57WMR. The stick circuit now includes front contact b of relay EMC, the recited track relay contacts, and front contact b of relay 57MOP. The pick up of relay EMC energizes relays WBC and EMAG. With relays EMC and WBC at station 57 picked up, the line circuit westward is energized, from source terminals LB and LN at front contacts g and h of relay WBC, over front contacts e and d of relay EMC. As previously discussed, relay WMR (at 51) is energized to pick up its R contacts. This reenergizes relay EBC (FIG. 3B) which picks up and sticks in the usual manner. When the 91 operator releases device EMCPB, both line circuits between station 51 and 91 are deenergized and the system is ready for the next train move between stations 51 and 91.

Assume now, with station 57 unmanned and traffic and signals for an eastbound move established as just described, the 51 operator returns signal 17EG to stop to permit a priority westbound move from station 91. He returns lever 13-17GL to its N position, so that relays 17GLP and 17H release and signal 17EG goes to stop. However, eastward traffic remains established in the line circuit and signals 23EG and 37EG at station 57 remain clear since there has been no train movement at that station. In other words, with front contact n of relay 57MOP closed, relay 37H is held by its stick circuit network including front contact Na of relay 37EGP and relay 23GLP, with front contact o of relay 57MOP closed, is held by front contact Nc of relay 37EGP. The 91 operator now actuates pushbutton EMNCPB to release relay 91AEM, that is, he cancels the eastward acknowledgement. This deenergizes the line circuit from station 91 so that relays 91AEMP and 57EH release. This releases relays 57REMP and AEM at station 57. The release of relay AEM deenergizes the line circuit to station 51 so that relays EH and REMP at that station release. The line circuits are now restored to normal.

The 91 operator now moves his westbound signal lever to request a movement to station 51. This energizes the line circuit to station 57 in a manner that relay 57WMR picks up its N contacts. When back contact Nb of relay 57WMR opens, it interrupts the stick circuit network for relay 37H (see circuit for relay 17H, FIG. 3A). The release of relay 37H restores signal 37EG to stop and pole-changes relay 37EGP to pick up its R contacts and release its N contacts. Front contact Nc of relay 37EGP opens to deenergize relay 23GLP which releases to place signal 23EG to stop. The westward move can now be set up in a manner similar to that previously discussed for the eastbound move. When relay WH at station 57 picks up to enable the clearing of signal 27WG, front contact f of relay WH completes a circuit to reenergize relay 23AS, still released from the cancelled eastward traffic, without waiting for a timing period. This circuit also includes front contact Rb of relay 37EGP, front contact p of relay 57MOP, and back contact a of relay 23GLP. Relay 37AS will pick up only at the end of its timing period.

Each disclosed arrangement of my invention thus provides a safe and economic system for controlling train movement through a single track railroad in which continuous train detection in the single track stretches is not provided. Although the system is under operator manual control, complete safety is assured by requiring positive action by both station operators to establish traffic direction between two adjacent stations and clear a departure signal. Movement of the train locks the system to protect the train in the single track stretch. Then positive action by the exit station operator to confirm completion of the train move is required to unlock and reset the system. The system requires installation of a minimum amount of new apparatus consistent with existing communication channels and station interlocking equipment. The circuits may also be arranged to allow selected stations to be unmanned when low traffic conditions make this desirable. The result is a safe, efficient, and economical traffic control system for single track railroads having low train density.

Although I have shown and described but two specific arrangements embodying the traffic control system of my invention, changes and modifications therein within the scope of the appended claims may be made without departing from the spirit and scope of my invention.

Having thus described my invention, what I claim as new and desire to secure by Letters Patent is:

1. A traffic control and signal system for a single track railroad over which trains move in either direction between first and second stations, under authority of wayside departure signals at each station, comprising, (a) a communication channel coupling said first and second stations, (b) request means at each station coupled to said communication channel and manually operable for transmitting to the other station a first signal requesting a train movement from the associated station to the other station, (c) a register means at each station coupled to said channel for receiving said first signal and manually operable, in response to the reception of said first signal, for transmitting to the other station a second signal acknowledging and accepting said train movement request.

(d) a wayside signal control means at each station enabled by the transmission of said first signal and responsive to the subsequent reception of said second signal for actuating the associated departure signal to authorize said requested train movement to the other station, (e) said communication channel further controlled in response to a train departure from the associated station for inhibiting the transmission of any first or second signal from either station while said train traverses the single track stretch, (f) a detection means at each station coupled to the track and responsive only to the arrival of an inbound train from the other station for registering that train's arrival, (g) each detector means coupled to said communication channel and manually operable for transmitting a third signal to the other station, when a train arrival is registered, to confirm the completed train movement and to actuate a reset of both stations and said communication channel to enable preparation of the system for a subsequent train movement in either direction.

2. A railroad traffic control and signal system as defined in claim 1 in which, (a) said communication channel comprises a first and a second line circuit extending between the two adjacent stations, each normally energized with a predetermined polarity applied at a different one of said stations, (1) each line circuit terminating in a line relay means at the other station operable for detecting the existing polarity of the applied energy and the absence of energy, (b) each line circuit controlled by said request means at its energizing station for reversing the polarity of the applied energy to transmit said first signal, (c) each register means controlled by the associated line relay means for registering the reception of a first signal from the other station, (d) each line circuit also controlled by the associated register means at its energizing station for reversing the polarity of the applied energy to transmit a second signal when that registry means is manually operated after a first signal is received at that station, (e) each line circuit responsive to the departure of a train from its energizing station for interrupting the transmission of energy to the other station until a third signal is subsequently received from that other station, and (f) each line circuit further controlled by the detection means at its energizing station for restoring said predetermined polarity of the applied energy to transmit a third signal when that detection means is manually operated in response to the detection of an arriving train.

3. A traffic control and signal system as defined in claim 1 in which, (a) said communication channel comprises a normally deenergized, reversible, direct current two-wire line circuit network extending between said first and second stations, (b) said line circuit network controlled by said request means at each station for applying energy of a predetermined polarity to transmit a first signal when a request means is actuated, (1) said line circuit network at each station also responsive for recording the reception of a similar polarity first signal from the other station, (c) said line circuit network also controlled by said register means at each station for applying energy of the opposite polarity to transmit a second signal from a station when the associated register means is actuated following reception of a first signal from the other station, (d) each wayside signal control means is coupled to said line circuit network in response to the transmission of a first signal from the associated station for receiving a second signal transmitted from the other station and responsive thereto for clearing an associated departure signal to authorize a train to begin the requested movement, (e) said line circuit network coupled to the track at each station and responsive to the detection of a departing train for interrupting the line circuit to inhibit transmission of any signals while that train travels to the other station, (f) said line circuit network further controlled by the detection means at each station for applying energy of said opposite polarity to transmit a third signal from the corresponding station when a detection means is manually operated to confirm the completed train arrival at that station, and (g) said line circuit network responsive to deactivation of the actuated detection means to terminate the third signal for restoring the normal deenergized condition.

4. In a manual block traffic control system for a single track railroad, in which coordination between operators at adjacent stations is required to establish a desired traffic direction and clear wayside signals for a train move from one station to another station, and with a separate communication channel coupling each pair of adjacent stations, at each station along said railroad the combination comprising, (a) a separate terminating network for the communication channel extending in each direction to an adjacent station including receiver means for distinguishing the characteristic of signals received from the associated adjacent station over that channel, (b) a first and a second request menas, one coupled to each channel network and manually operable for transmitting a first signal having a first selected characteristic to the corresponding adjacent station to request a train movement to that station, (c) a first and second acknowledging means, one coupled to each network for receiving and registering a first signal received from the corresponding adjacent station, (1) each acknowledging means further coupled to the associated network and manually operable for transmitting a second signal having a second distinctive characteristic to accept the train movement request received from the associated adjacent station, (d) a first and a second signal control means, one coupled to each network and responsive to the reception of a second signal from the associated adjacent station for clearing a wayside departure signal to authorize the requested train movement through the single track to the adjacent station, (e) a first and second lockout means, one coupled to each network and responsive to the departure of a train in the corresponding direction for inhibiting the transmission of first or second signals over that channel to establish conflicting traffic direction or signals while that train traverses the single track to the adjacent station, (f) a first and a second detector means, one coupled to the track at each entrance to said station and responsive only to the arrival of a train from the corresponding adjacent station for indicating to the station operator that a train has arrived within the station from that direction, (g) a first and a second manually operable registry means, one coupled to the track at each end of said station and controlled by the associated detector means, each operable for confirming the completion of a train movement from the corresponding adjacent station, and (h) each registry means coupled to the associated network for transmitting a third signal to the adjacent station when train arrival has been confirmed for resetting that communication channel network and adjacent station apparatus to enable preparation for the movment of another train in either direction.

5. In a manual block traffic control system, station apparatus as defined in claim 4 which further includes, (a) a station bypass means normally occupying a first condition and operable at selected times to a second condition, (b) said bypass means in its second condition coupling each network receiver means to the other network for applying energy to transmit first and second signals received from one adjacent station to the other adjacent station, (c) said detector means coupled by said bypass means in its second condition to the associated receiver means and responsive to the joint transmission of first and second signals between the adjacent stations in each direction for simulating the arrival of a train at said station in a direction corresponding to that of the first signals transmission, and (d) said signal control means are controlled by said bypass means and by said detector means for clearing signals to authorize the requested train movement into and to depart from said station when said bypass means occupies its second condition and said detector means simulates a train arrival.

6. In a manual block traffic control system, station apparatus as defined in claim 4 which further includes, (a) a station bypass means normally occupying a first condition and operable at selected times to a second condition, and in which, (b) each request means is coupled by said bypass means in its second condition to the receiver means of the other network and is responsive to the reception of a first signal from the other adjacent station for transmitting a first signal to its associated adjacent station, (c) each acknowledging means is coupled by said bypass means in its second condition to the other network receiver means and is responsive to the reception of a second signal for transmitting a second signal to the associated adjacent station, (d) each signal control means controlled by said bypass means in its second condition for clearing a departure signal when the associated request means is actuated by a first signal received from one adjacent station and a second signal received from the other adjacent station, (1) each signal control means is further controlled by said bypass means in its second condition and responsive to the clearing of the corresponding departure signal for clearing a station entering signal for the corresponding direction of movement, and (e) each detection means is coupled by said bypass means in its second condition for responding to the reception of a third signal by the other network receiver means from the other adjacent station for transmitting a third signal to the associated adjacent station.

* * * * *